US005822664A

United States Patent [19]

Oka et al.

[11] Patent Number: 5,822,664

[45] Date of Patent: Oct. 13, 1998

[54] DEVELOPING MACHINE WHICH USES A DEVELOPING AGENT INCLUDING A TONER AND MAGNETIC PARTICLES

[75] Inventors: Seiji Oka, Yokohama; Hajime Oyama, Ichikawa; Yasushi Akiba, Tokyo; Kiyonori Tsuda, Machida, all of Japan

[73] Assignee: Ricoh Company, Ltd., Tokyo, Japan

[21] Appl. No.: 581,498

[22] Filed: Dec. 29, 1995

[30] Foreign Application Priority Data

| | | | |
|---|---|---|---|
| Dec. 31, 1994 | [JP] | Japan | 6-340214 |
| Jan. 5, 1995 | [JP] | Japan | 7-016485 |
| Jan. 14, 1995 | [JP] | Japan | 7-021151 |
| Apr. 20, 1995 | [JP] | Japan | 7-119340 |
| Nov. 30, 1995 | [JP] | Japan | 7-337986 |

[51] Int. Cl.[6] ..... G03G 15/08

[52] U.S. Cl. ..... 399/284; 399/260

[58] Field of Search ..... 399/222, 252, 399/254, 255, 258, 259, 260, 264, 262, 265, 273, 274, 279, 281, 283, 284

[56] References Cited

U.S. PATENT DOCUMENTS

| | | | |
|---|---|---|---|
| 5,188,057 | 2/1993 | Ishikawa et al. | 399/274 X |
| 5,383,009 | 1/1995 | Tsusaka | 399/259 X |
| 5,502,552 | 3/1996 | Iwata et al. | 399/222 |

FOREIGN PATENT DOCUMENTS

| | | |
|---|---|---|
| 64-21469 | 1/1989 | Japan . |
| 2-118682 | 5/1990 | Japan . |
| 6-43758 | 2/1994 | Japan . |

*Primary Examiner*—S. Lee

*Attorney, Agent, or Firm*—Oblon, Spivak, McClelland, Maier & Neustadt, P.C.

[57] ABSTRACT

A developing machine is provided which includes a supporting case (2); a developing sleeve (4) mounted within the supporting case (2), for carrying a developing agent (3); a magnetic roller (15) mounted within the developing sleeve (4); a projection (5*d*) for thinning a layer of the developing agent (3) carried on the developing sleeve (4) and regulating the amount of the developing agent (3); a drift portion A having a predetermined capacity, in which the developing agent (3) stopped by the projection (5*d*) drifts about; a toner containing portion (5*b*) having a toner supplying opening 5*c* which faces the developing sleeve (4) and is contiguous to the drift portion A on the upstream side of a direction in which the developing agent (3) on the developing sleeve (4) is carried; a developing agent storage case (5) attachable to and detachable from the supporting case (2), including the developing sleeve (4) and the toner containing portion (5*b*); and a developing agent retrieving device for a scraping the developing agent (3) lying on the developing sleeve (14) and retrieving the scraped developing agent (3) into the toner containing portion (5*b*).

12 Claims, 15 Drawing Sheets

DEVELOPING MACHINE WHICH USES A DEVELOPING AGENT INCLUDING A TONER AND MAGNETIC PARTICLES

BACKGROUND OF THE INVENTION

1. Field of the Invention

This invention relates generally to a developing machine for use in an image forming apparatus, such as a copy machine, facsimile machine, or printer, and more particularly to a developing machine in which a latent image generated on a latent image carrying medium is developed by means of a developing agent which consists of a toner and magnetic particles.

2. Description of the Related Art

In order to develop a latent image formed on a latent image carrying medium by using a toner, a two-component development method is known in which use is made of a two-component developing agent (shortly referred to as "a developing agent" in the following) which consists of toner particles and magnetic particles. This is typically called a magnetic brush development method (see U.S. Pat. No. 2,874,063, for example).

In the two-component development method, deterioration of the developing agent (what is called "toner spent") occurs because of repetition of a developing process for a lengthy period of time. That is, the toner is fused to the surface of the magnetic particle. The deterioration of the developing agent makes it difficult to supply the toner with sufficient electric charge, thus generating an abnormal image. Accordingly, there is need of replacing the developing agent with a new one at regular intervals. Some methods for the replacement thereof are known. For example, one of them is that a service person periodically calls a user and loads a new developing agent in the machine, and another method is that the user takes out a used developing agent from the machine and sets a new toner cartridge, which includes a developing agent and a toner individually, in the machine.

A developing machine adopting the two-component development method is known which includes a member for stirring and, at the same time, conveying a developing agent in order to make a toner density uniform or control the charge on the toner. According to this type of developing machine, it is possible to retrieve and keep a used developing agent in a predetermined place by driving the stirring and conveying member when the developing agent is replaced by another. This is disclosed in, for example, Japanese Patent Application Early Laid-open Publication Nos. Sho 64-21469, Hei 2-118682, and Hei 6-43758.

According to the two-component development method, toner particles are each kept in contact with the surface of a magnetic particle by the force of static electricity generated by friction between the magnetic particles relatively large in size and the toner particles small in size. In more detail, when the toner particles approach an electrostatic latent image, the suction force of an electric field forming the latent image with respect to the toner particles toward the latent image surpasses the binding force between the toner particles and the magnetic particles and, as a result, the toner particles are attracted to the latent image. Thereby, the latent image is made visible. Since the toner is consumed in this developing process, the developing agent is replenished with another toner and is used again. Accordingly, in order to obtain a stable image density by the two-component development method, a toner density or a mixture ratio between magnetic particles and toner particles must be made constant. To make it constant, it is required that the developing machine further includes a toner replenishing mechanism, a toner density sensor, and the like. However, the addition of them thereto leads to enlargement of the size of the developing machine and causes the complicated operation of the machine.

Thus, in order to accomplish a small-sized and low-cost developing machine, a developing machine has been proposed which is capable of lessening an amount of developing agent to be contained in the machine and is capable of controlling a toner density and toner charge without a complicated mechanism which has a developing agent stirring and conveying member, a toner density sensor, and the like.

For example, Japanese Pat. Official Gazette No. Hei 5-67233 discloses a technique. According to the technique, a layer of magnetic particles is formed on a developing agent carrying medium within a case, and a toner is contained in a toner supplier within the case so as to come in contact with the layer of the magnetic particles. The toner is taken in the layer of the magnetic particles in accordance with movement of the magnetic particles which is caused by rotation of the developing agent carrying medium. The toner is charged by circulating the developing agent which is a mixture of the toner and magnetic particles in an area formed on an upstream side of a developing agent regulating member with respect to a rotational direction of the developing agent carrying medium. Thereafter, the thickness of the layer is regulated by the developing agent regulating member, and then the charged toner is conveyed to a development area.

According to this technique, a developing machine can be made small-sized and low cost without providing the developing machine with a developing agent stirring and conveying member or a complicated mechanism for controlling a toner density. In addition, the toner can be charged sufficiently and, at the same time, the toner density can be made generally stable.

Another type of developing machine adopting the two-component development method is known. In this developing machine, a developing agent regulating member regulates an amount of developing agent which is being carried by a developing agent carrying body. After that, the developing agent is conveyed to a development area which faces an image carrying body, so that a latent image generated on the image carrying body is supplied with a toner to develop the latent image. The developing agent which has been regulated by the developing agent regulating member is retained in a developing agent retaining portion which is made of, for example, a storage case.

In this type of developing machine, the developing agent within the retaining portion in the vicinity of the developing agent carrying body is under the influence of a magnetic field generated by a magnetic field generating means which is mounted within the developing agent carrying body.

Still another type of developing machine adopting the two component development method is known. This type of developing machine includes a tube-shaped developing agent carrying body which carries a developing agent on its surface, and a magnetic field generating member which is mounted within the developing agent carrying body and generates a predetermined magnetic field on the surface of the developing agent carrying body. The ends of the developing agent carrying body in a longitudinal direction thereof are supported by a supporting mechanism.

FIG. 22 shows in example of various types of supporting mechanisms. In FIG. 22, a developing roller 100 comprises a tube-shaped developing sleeve 101 and a magnetic roller

102. The developing sleeve 101 acts as a developing agent carrying body. The magnetic roller 102 acting as a magnetic field generating member is mounted in the developing sleeve 101 and has shafts 200, 200 at both the ends of the magnetic roller 102, respectively.

Flanges 122, 123 are attached to openings formed in the ends of the developing sleeve 101, respectively. The flange 123 right-hand in FIG. 22 has a shank 123*a* extending outward. The shank 123*a* is supported by a rear side plate 126 of the machine through a bearing 124. The shank 123*a* has a hollow portion through which the right-hand shaft 200 of the magnetic roller 102 passes. The right-hand shaft 200 is received by bearings 121, 121 which are pressed into the ends of the hollow portion. A driving member 119, such as a gear, for communicating driving force to the developing sleeve 101 is attached to an end of the shank 123*a* extending from rear side plate 126.

On the other band, the flange 122 left-hand in FIG. 22 has a center hole through which a left-hand shaft 200 of the magnetic roller 102 passes toward the outside. The shaft 200 is supported by a front side plate 125 through the bearing 124. A left-hand end of the developing sleeve 101 is received by the shaft 200 through the bearing 121 which is pressed into the center hole of the flange 122.

FIG. 23 shows another supporting mechanism. A developing roller 100 shown in FIG. 23 also comprises a tubular developing sleeve 101 and a magnetic roller 102. The magnetic roller 102 serving as a magnetic field generating member is mounted in the developing sleeve 101 and has shafts 200*a*, 200*b* at both ends thereof respectively.

The ends of the developing sleeve 101 are supported by front and rear side-plates 125, 126 through supporting members 127, 128 each of which has an annular flange. The outer surface of the flange is fit in a hole formed in each side plate 125 (126), whereas the inner surface of the flange receives the outer surface of the end 101*a*(101*b*) of the developing sleeve 101.

The supporting member 128 right-hand in FIG. 23 has a through-hole in the middle thereof. The right-hand end 101*b* of the developing sleeve 101 passes through the hole and extends from the rear side plate 126 toward the outside. A driving member 119, such as a gear, for communicating driving force from the outside to the developing sleeve 101 is disposed on the outer surface of the right-hand end 101*b*. Further, at the right-hand end 101*b* of the developing sleeve 101, a side plate portion 129 is formed which serves as an engagement portion engaged with the shaft 200*b* of the magnetic roller 102 and serves as a cover for the hollow of the developing sleeve 101. The engagement portion is formed detachably from the shaft 200*b*.

On the other hand, in the left-hand supporting member 127, an engagement portion is formed which is engaged with the shaft 200*a* of the magnetic roller 102. This engagement portion is also formed detachably from the shaft 200*a*. The supporting member 127 is detachable from the hole of the front side plate 125 and from the outer periphery of the developing sleeve 101.

(Problem 1)

By the way, in a small-sized developing machine, such as that proposed in Japanese Patent Official Gazette No. Hei 5-67233, which has no developing agent stirring and conveying member or the like, it is impossible to uniformly convey a new developing agent to a development area after the replacement of a used developing agent. In other words, there is a problem in that complicated operations must be conducted to set a developing agent on a part corresponding to a development area as uniformly as possible when a used development agent is replaced.

(Problem 2)

Disadvantageously, a conventional developing machine is made large in size and weight because it includes a charging member, such as a paddle, for charging a toner, sensors for controlling a toner density, a device for supplying a toner, and the like. This makes it difficult to tilt a machine body in order to retrieve a used developing agent. In addition, since the inner construction of the developing machine is made complicated because of the addition of the charging member and the like thereto, it is difficult to retrieve the used developing agent completely.

Further, generally, in a developing machine in which the amount of a developing agent is set to become small with the aim of making the machine small-sized and low-cost, the lesser the amount of it is set, the shorter the life of the developing agent becomes. As a result, the number of times of replacement of it by another developing agent is increased. Accordingly, complicated operations are required to make a replacement at regular intervals. In addition, the installation of a special means for retrieving the used developing agent in the developing machine causes a rise in manufacturing costs.

(Problem 3)

In the developing machine proposed in Japanese Patent Official Gazette No. Hei 5-67233, a developing agent in the vicinity of a developing agent carrying body takes a toner in, and thereafter a developing agent regulating member regulates the developing agent so as to charge the toner. In this process, a mechanism for supplying a toner or a sensor for detecting a toner density is not required, but it is impossible to use a developing agent larger in quantity than that used in a conventional developing machine adopting the two-component development method. Accordingly, when the linear velocity of the surface of a developing agent carrying body of the machine is high, the toner cannot be sufficiently charged, and thus the surface of the carrying body becomes dirty.

On the other hand, in order to charge the toner sufficiently, regulation stress given by the developing agent regulating member must be strengthened. However, this causes a strong collision between particles of the developing agent, and thereby heat is generated. For this reason, a film of the toner is formed on the surface of the magnetic particle, in other words, "toner spent" (deterioration of the developing agent) is brought about. Accordingly, a charging characteristic of the magnetic particle goes down with the lapse of operating time, and thereby dispersion of the toner or fog occurs.

(Problem 4)

In a developing machine including a developing agent retaining portion, since a developing agent in the vicinity of an inner surface of a developing agent storing case is away from a magnetic field generating means which is mounted in a developing agent carrying body, a magnetic field generated by the magnetic field generating means does not exert a strong influence on the developing agent. Accordingly, if the developing machine leans or trembles, the developing agent tends to become uneven. A developing machine is known which is capable of preventing the unevenness of the developing agent. In this machine, a developing agent stirring and conveying mechanism stirs and conveys the agent by means of a screw member or paddle in a direction perpendicular to a direction in which a developing agent on a developing agent carrying body is conveyed, so that the agent is made even in the direction in which the stirring and conveying mechanism conveys it.

However, the addition of such a mechanism to the developing machine results in a large-sized and high-cost machine. In addition, disadvantageously, such a complicated mechanism makes it difficult to control a toner density or toner charge.

(Problem 5)

In the developing machine shown in FIG. 22, since the flanges 122, 123 of the developing roller 100 are pressed in or attached to the developing sleeve 101, it is difficult to demount the magnetic roller 102 from the developing roller 100 and reuse the magnetic roller In addition, as shown on the left side of FIG. 22, a construction is adopted in which the shaft 200 of the magnetic roller 102 is extended to the front side plate 125 outside the bearing 121 of the flange 122 and is received by the bearing 124 of the front side plate 125 in order to support the developing sleeve 101. Accordingly, disadvantageously, the developing machine is made large in size in the direction of the shaft 200.

In addition, since the shaft 200 is used to support the developing sleeve 101, there are additionally required the flange 122, the bearing 121 between the flange 122 and the shaft 200, and the bearing 124 between the shaft 200 and the front side plate 125. These additional components bring about a rise in manufacturing costs.

On the other hand, in the developing machine shown in FIG. 23, the developing sleeve 101 has an opening at one end 101a thereof, and the supporting member 127 having a side plate portion for closing the opening is detachable from the end 101*a*. The right-hand shaft 200*b* of the magnetic roller 102 is also detachable from the side plate portion 129 of the developing sleeve 101. Accordingly, advantageously, the magnetic roller 102 can be easily pulled out of the developing sleeve 101 and be reused by removing the supporting member 127 from the developing sleeve 101 and the front side plate 125 in order to open the end 101*a* toward the outside. In addition, without adopting a shaft type construction to support the developing sleeve 101 on the left side of FIG. 23 which is not a drive-input-side, the end 101*a* of the developing sleeve 101 is directly supported by the side plate 125 through the supporting member 127 which is in contact with the outer surface of the developing sleeve 101. This construction contributes to the downsizing of the developing machine in the axial direction.

However, in the developing machine shown in FIG. 23, since the supporting member 127 is in contact with the outer surface of the developing sleeve 101, a developing agent is liable to enter a gap between the supporting member 127 and the developing sleeve 101. By the developing agent therebetween, the supporting member 127 and the developing sleeve 101 are abraded whenever the developing sleeve 101 rotates in a circumferential direction.

There is another problem in the following. When the magnetic roller 102 is replaced, the supporting member 127 shown on the left side of FIG. 23 is first taken off, and then the magnetic roller 102 is pulled out through the hole formed in the side plate 125. In this state, a gap is generated between the hole and the circumferential surface of the developing sleeve 101, as shown in FIG. 24(*a*). Owing to the magnetic force of the magnetic roller 102 which is being pulled out, a developing agent 3 which has moved on the surface of the developing sleeve 101 is liable to pass through the hole. Accordingly, disadvantageously, the developing agent 3 which has passed through the hole drops down from the end of the developing sleeve 101 and is attracted to the magnetic roller 102. As a result, the magnetic roller 102 is contaminated with the developing agent 3.

Such a disadvantage also occurs in a construction shown in FIG. 24(*b*). In this construction, the through-hole is made smaller than the diameter of the developing sleeve 101, and the end of the developing sleeve 101 is arranged not to locate within the through-hole. However, the developing agent 3 drops down from a gap between the front side plate 125 and the end of the developing sleeve 101 and from a gap between the through-hole and the magnetic roller 102.

In addition, in the developing machine shown in FIG. 22, it is practically difficult to take out only the developing roller 100 from the machine in order to retrieve the developing agent or clean down the inside of the developing machine. For this reason, the whole machine must be disassembled to do so. Even in the developing machine shown in FIG. 23, close attention must be paid when the developing roller 100 is taken out.

If such a supporting member 127 as shown in FIG. 23 is used to support at least one end of a developing roller 100, for example, to support the end thereof on the front side of the machine, a magnetic roller mounted in a developing sleeve can be taken out and be replaced. If so, such a flange 123 with a shaft as shown in FIG. 22 can be used to support the other end thereof.

However, in this construction, pressing or gluing operations are required to attache the flange 123 with the shaft to the end of the developing sleeve so as not to rotate relatively. Accordingly, the improvement of a construction for supporting an end or ends of a developing roller has been expected in which such operations can be carried out at lower cost than hitherto.

SUMMARY OF THE INVENTION

It is therefore a first object of the present invention to provide a developing machine in which complicated mechanisms, such as those for controlling a toner density, are not required to make the machine small-sized and low-cost and in which a user can set a new toner and, at the same time, replace a used developing agent by another without carrying out complicated operations for evening the developing agent.

It is a second object of the present invention to provide a developing machine in which a developing agent storage case which has a function to control a toner density and a function to charge a developing agent is small in size, light in weight, and easy in operation and, in addition, the developing agent can be retrieved into the storage case and, in addition, the storage case can be easily detached from the machine in order to replace the developing agent within the machine.

It is a third object of the present invention to provide a developing machine which is a small-sized low-cost machine without a toner supplying mechanism, a toner density sensor, and the like and is capable of charging a toner uniformly.

It is a fourth object of the present invention to provide a developing machine which is a small-sized and low-cost machine without a complicated mechanism for stirring and conveying a developing agent and is capable of preventing the unevenness of the developing agent in a direction perpendicular to a direction in which the developing agent is conveyed on a developing agent carrying medium even if there is an area where the developing agent is not strongly influenced by a magnetic field generated by a magnetic field generating means of the developing agent carrying medium, the area being in a drift space in which the developing agent stopped by a developing agent regulating member drifts.

It is a fifth object of the present invention to provide a developing machine in which a magnetic field generating member mounted in a developing agent carrying medium can be easily taken out from the machine, and abrasion can be reduced between a developing sleeve of the developing agent carrying medium and a receiving member for the developing sleeve.

It is a sixth object of the present invention to provide a developing machine in which a developing agent on a developing sleeve is not attracted to a magnetic field generating member when the magnetic field generating member is taken out from the developing sleeve.

It is a seventh object of the present invention to provide a developing machine which is capable of easily cleaning down the inside of the machine.

It is an eighth object of the present invention to provide a developing machine which includes a construction for supporting at least one end of a developing agent carrying medium and in which a flange is attached to an end of a developing sleeve so as not to rotate relatively, attaching operations being carried out at low cost.

In order to achieve the object(s), a developing machine according to an aspect of the present invention comprises a developing agent carrying medium for carrying a developing agent on a surface thereof, the developing agent consisting of toner particles and magnetic particles; a supporting case for supporting the developing agent carrying medium; a magnetic field generating means disposed within the developing agent carrying medium; a developing agent regulating member by which an amount of the developing agent carried on the developing agent carrying medium is regulated; a drift portion having a predetermined capacity, within which the developing agent stopped by the developing agent regulating member drifts; and a toner containing portion having an opening through which a toner is supplied, the opening being contiguous to the drift portion on an upstream side of a direction in which the developing agent is carried and facing the developing agent carrying medium. The developing machine further comprises a developing agent container including the drift portion and the toner containing portion, the developing agent container being attachable to and detachable from the supporting case; and a developing agent retrieving means for scraping off and retrieving the developing agent carried on the developing agent carrying medium so as to put the developing agent into the toner containing portion.

In order to achieve the object(s), a developing machine according to another aspect of the present invention comprises a developing device including a developing agent carrying medium facing a latent image carrying medium, the developing agent carrying medium rotationally carrying a developing agent which consists of toner particles and magnetic particles, and a magnetic field generating means; in which a layer of the developing agent is formed on the developing agent carrying medium, and the magnetic particles in the layer of the developing agent are circularly moved in the layer such that the magnetic particles are upward moved in accordance with rotation of the developing agent carrying medium in a direction whereas the magnetic particles are downward moved in accordance with rotation of the developing agent carrying medium in an opposite direction, thereby taking the toner particles lying on a magnetic particle layer into the magnetic particle layer. In the developing machine, the developing device includes a developing agent regulating member, and a given gap is defined over the developing agent carrying medium within a range from the developing agent regulating member to a place on an upstream side of a direction in which the developing agent is carried during image formation. The developing device further includes a developing agent maintaining portion. The developing agent maintaining portion comprises a toner charging portion for charging a toner conveyed from the upstream side to the gap, and a toner density controlling portion for controlling a toner density by circulating the developing agent within a space larger in capacity than the given gap on the upstream side of the toner charging portion.

Other aspects, objects, and advantages of the present invention will become apparent to one skilled in the art from a reading of the following disclosure and the appended claims.

DETAILED DESCRIPTION OF THE PREFERRED EMBODIMENTS

A detailed description will be hereinafter given of embodiments of a developing machine of an electrophotographic copy machine (briefly referred to as "copy machine" in the following) used as an image forming apparatus.

(First Embodiment)

Figure 1:
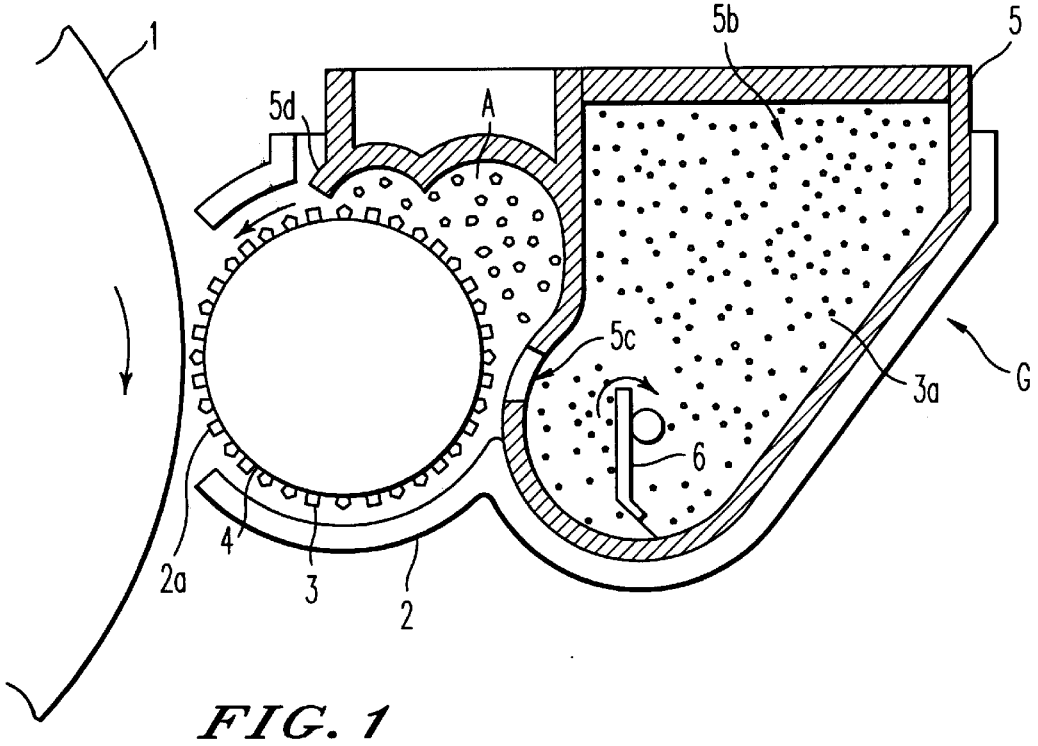
FIG. 1 is a partly sectional schematic view of a developing machine according to a first embodiment of the present invention.

FIG. 1 is a partly sectional schematic view of a developing machine according to a first embodiment of the present invention.

The developing machine G is disposed on the lateral side of a cylindrical photosensitive drum 1 as an image carrying medium. The developing machine G comprises a supporting case 2, a developing sleeve 4, and a developing agent storage case 5. The supporting case 2 has an opening 2*a* which faces the photosensitive drum 1. The developing sleeve 4 serving as a developing agent carrying medium is partly open to the view from the opening 2*a*. The developing sleeve 4 carries a developing agent, which consists of a toner (i.e., toner powder or toner particles) and magnetic particles (magnetic particles are referred to as "carrier" in the following), on the surface of the developing sleeve 4. The developing agent storage case 5 is detachable from the supporting case 2. A developing roller is composed of the developing sleeve 4 and a magnetic roller. The magnetic roller consists of a group of stationary magnets fastened in the developing sleeve 4. The stationary magnets serve as magnetic field generating means. The magnetic polarity of the surface of the magnetic roller is graphically indicated in the developing sleeve 4.

The supporting case 2 has a developing sleeve containing part for containing and supporting the developing sleeve 4, and a storage case holding part for detachably holding the developing agent storage case 5. The developing agent storage case 6 held by the storage case holding part of the supporting case 2 has a developing agent drifting part A (which is later described in detail) where the developing agent 3 is circulated, and a toner containing part 5*b* where a new toner 3*a* is contained. In a state in which the developing agent storage case 5 is held by the storage case holding part of the supporting case 2, an opening of the developing agent drifting part A of the developing agent storage case 5 faces the developing sleeve 4, and a toner supplying hole 5*c* of the toner containing part 5*b* of the developing agent storage case 5 faces the developing sleeve 4 at the lower side of the developing agent drifting part A. In the immediate vicinity of the toner supplying hole 5*c*, a toner stirrer 6 is disposed for sending out the toner 3*a* to the hole 5*c*. A layer thinning projection 5*d* is disposed at a place upper than a development area, where the developing sleeve faces the photosensitive drum 1, in a rotational direction of the developing roller, in other words, is disposed over the developing sleeve 4 in the figure. The projection 5*d* serves as a developing agent regulating member for regulating and thinning the layer of the developing agent 3 which is being carried on the surface of the developing sleeve 4. A part of the developing agent storage case 5 is used as the projection 5*d*. In this embodiment, the projection 5*d* is formed integrally with the developing agent storage case 5. Accordingly, the developing agent storage case 5 must be replaced in order to replace the projection 5*d* by a new one.

Figure 2:
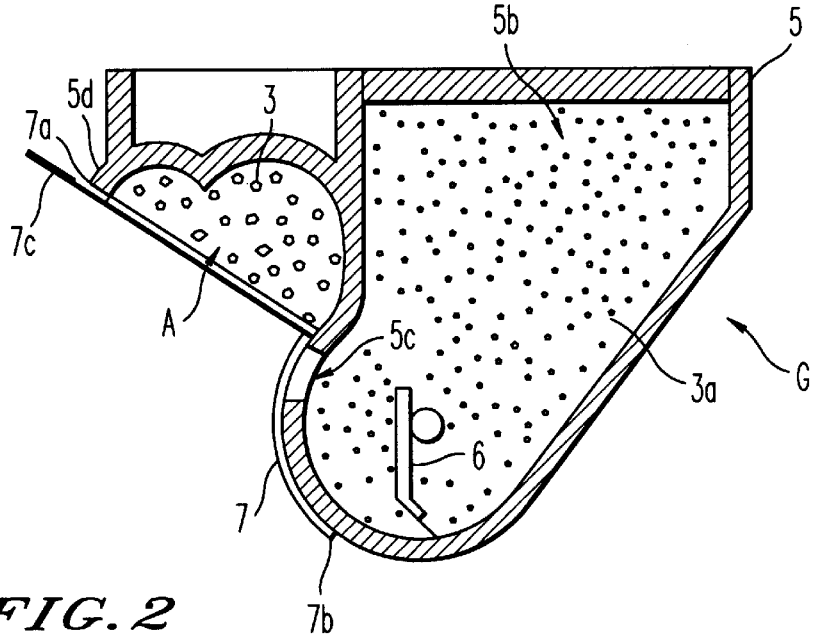
FIG. 2 is a sectional schematic view of a developing agent storage case showing a state in which it is not attached to the developing machine yet.
Figure 3:
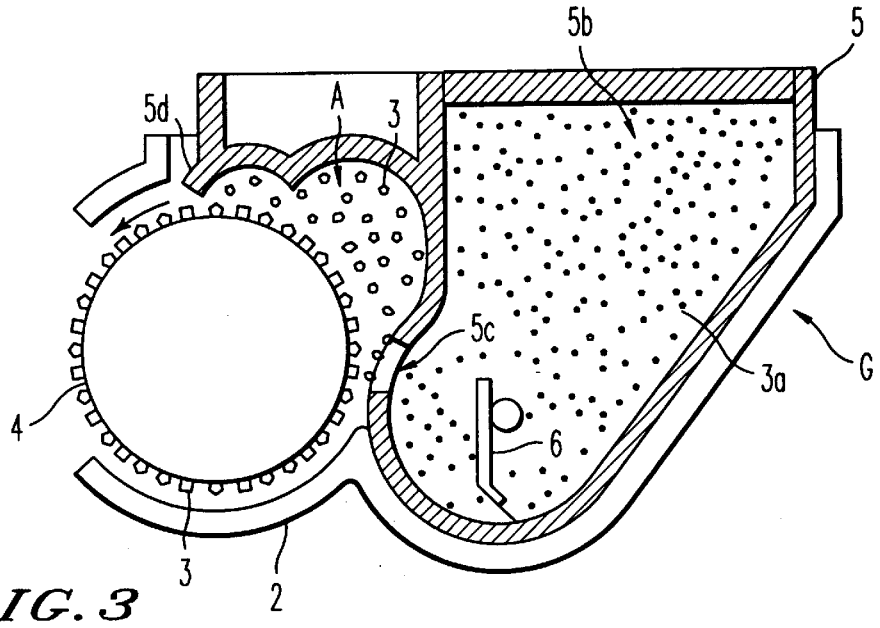
FIG. 3 is a sectional front view of the developing machine in which a toner density is high.
Figure 4A:
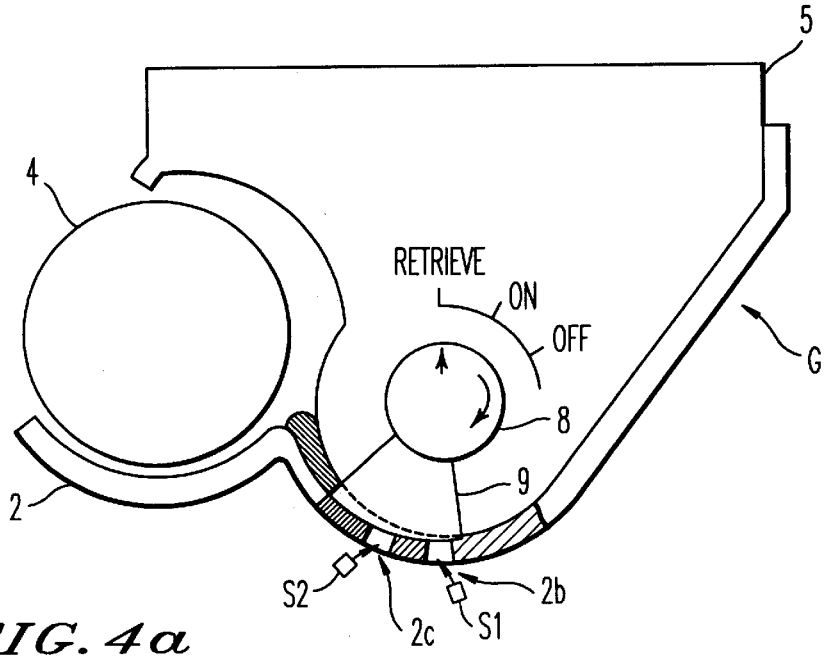
FIG. 4(*a*) is a front view of the developing machine in which an image is being formed, and FIG. 4(*b*) is a descriptive drawing of a mechanism for retrieving a developing agent.
Figure 4B:
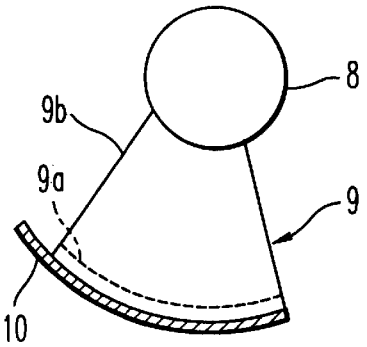

FIG. 2 is a sectional view of the developing agent storage case 5 which has not yet attached to the supporting case 2 of the developing machine G. The storage case 5 in this state has a sealing member 7 for sealing the opening of the developing agent drifting part A in which a new developing agent is contained and sealing the hole 5*c* of the toner containing part 5*b*. An end 7*a* of the sealing member 7 is glued to the surface of the projection 5*d* with adhesive strength, but the two are easily pulled apart. The sealing member 7 is also glued to a side wall of the storage case 5 so as to seal the opening of the developing agent drifting part A and the hole 5*c*. In addition, the sealing member 7 is folded back at a place designated by reference character 7*b* so as to return the other end thereof to the projection 5*d*. The other end of the sealing member 7 is provided with a tag 7*c*. After attaching the storage case 5 to the supporting case 2, a user pulls the tag 7*c* in a direction of an arrow to take off the sealing member 7. As a result, the developing agent 3 drops from the developing agent drifting part A to the surface of the developing sleeve 4, so that the developing sleeve 4 can carry the developing agent 3. At the same time, the toner 3*a* is also supplied from the toner containing part 5*b* thereto.

In the developing machine G thus constructed, the developing agent 3 which has dropped to and is carried by the developing sleeve 4 is conveyed in accordance with the rotation of the developing sleeve 4 in the direction of an arrow. The developing agent 3 lying on the developing sleeve 4 is then thinned by the projection 5*d* formed integrally with the storage case 5. The thinly leveled developing agent 3 is conveyed to a development area which faces the photosensitive drum 1 rotating in the direction of an arrow. Thereafter, the developing agent 3 is supplied to an electrostatic latent image formed on the photosensitive drum 1, so that the latent image is made visible. The remaining developing agent 3 which has not been used for the visualization is conveyed in accordance with the rotation of the developing sleeve 4 and is supplied with a new toner 3*a* through the toner supplying hole 5*c*. The developing agent 3 with the new toner 3*a* again returns to the developing agent drifting part A. The developing agent 3 with the new toner 3*a* is moved up and down between the projection 5*d* and the developing sleeve 4, and thereby the toner 3*a* is charged.

On the other hand, a part of the developing agent 3 which has been stopped by the projection 5*d* without reaching the development area is moved toward the hole 5*c* of the toner containing part 5*b* because of gravity and inner pressure caused by the developing agent 3 itself within the drifting part A. The developing agent 3 which has been moved close to the hole 5*c* is conveyed in accordance with the rotation of the developing sleeve 4 so as to circulate toward the projection 5*d*.

In the developing machine G, when all the toner 3*a* in the toner containing part 5*b* is used up, the developing agent 3 within the developing agent drifting part A and on the developing sleeve 4 is retrieved and put into the empty part 5*b* of the storage case 5. Thereafter, the storage case 5 is detached from the supporting case 2 and, instead, a new storage case 5 shown in FIG. 2 is attached thereto.

The developing machine G has optical sensors S1, S2 serving as movement detecting means for detecting the movement of a mylar plate 10. The sensors S1, S2 are disposed at places which face holes formed in the lower wall of the supporting case 2, respectively.

Figure 5A:
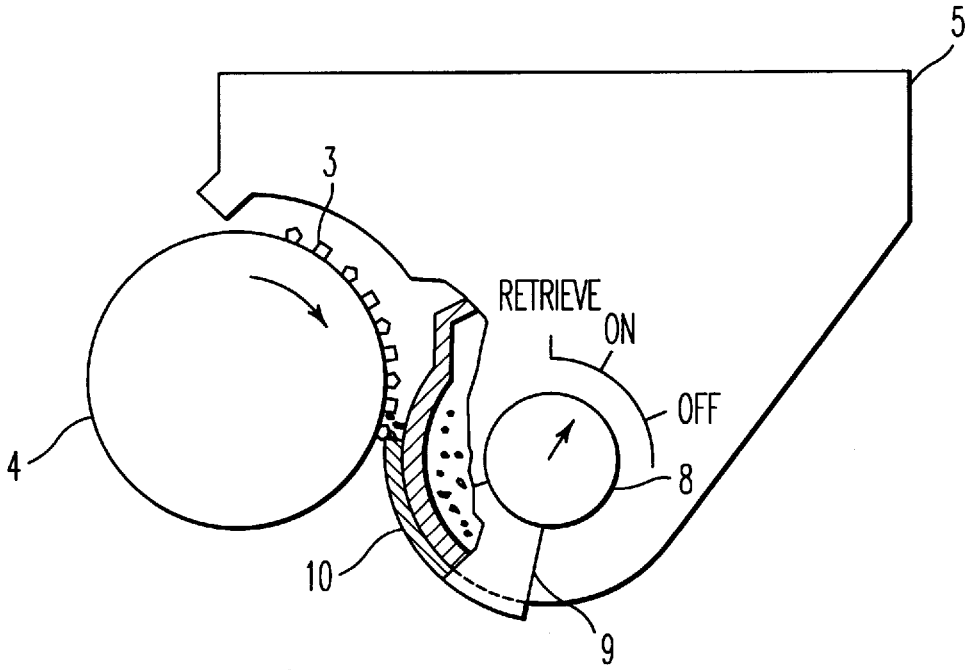
FIG. 5(*a*) is a front view of the developing machine in which the developing agent is being retrieved, and FIG. 5(*b*) is an enlarged view of a movement detection part of a developing agent guiding member when the developing agent is being retrieved.
Figure 5B:
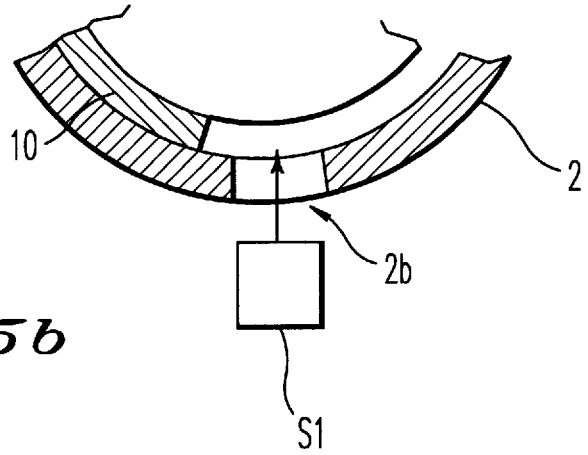

As shown in FIG. 5(*b*), the hole 2*b* is closed with the mylar plate 10 when an image-formation process is being carried out. The hole 2*b* is formed at a place through which a rear end of the mylar plate 10 passes when a front end of the same 10 is moved to come in contact with the surface of the developing sleeve 4.

Figure 6A:
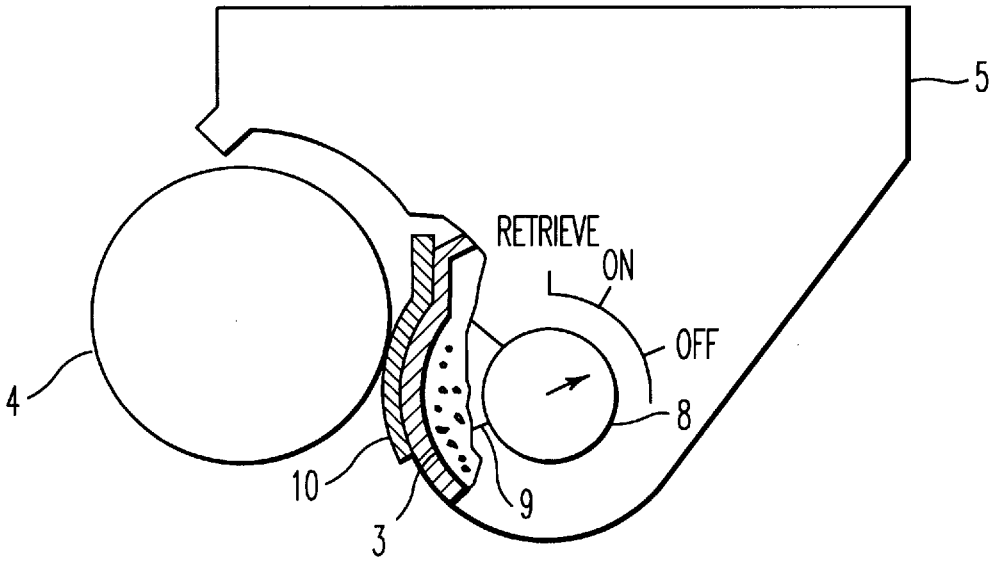
FIG. 6(*a*) is a front view of the developing machine in which the retrieve of the developing agent is completed, and FIG. 6(*b*) is an enlarged view of a movement detection part of a developing agent guiding member when the retrieve thereof is completed.
Figure 6B:
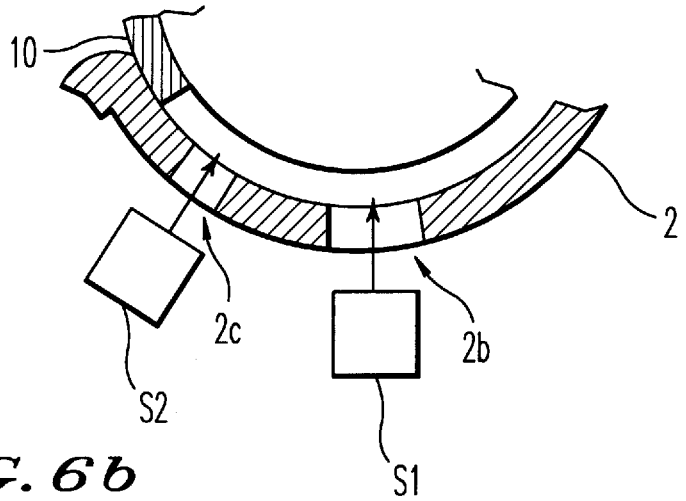

As shown in FIG. 6(*b*), the hole 2*c* is closed with the mylar plate 10 when the image-formation process is being carried out and the mylar plate 10 is in contact with the developing sleeve 4. The hole 2*c* is formed at a place through which the rear end of the mylar plate 10 passes when the mylar plate 10 is moved to a place given when the retrieve of the developing agent is completed. As the optical sensors S1 and S2, use is made of, for example, a reflection type of optical sensor in which a beam of light reflected by the mylar plate 10 is detected.

A reversible motor (not shown) is used as a means for driving the developing sleeve 4. A control means is disposed for controlling the reversible motor on the basis of a detection result of movement of the mylar plate 10 by means of the sensors S1, S2. For example, a control unit of the copy machine can be used as the control means.

Before replacing the storage case 5 in which the toner 3*a* within the toner containing part 5*b* has been used up, the user retrieves the developing agent in the following way.

First, as shown in FIG. 5(*a*), the user rotates a knob 8 in the right direction so that a bold-faced arrow in the figure points out the mark "ON". According to the rotation of the knob 8, the mylar plate 10 is moved, so that the end of the mylar plate 10 comes in contact with the surface of the developing sleeve 4. As shown in FIG. 5(*b*), the sensor S1 detects the movement of the mylar plate 10. Based on a detection result obtained by the sensor S1, the developing sleeve 4 is rotated in a direction opposite to a normal direction taken when an image is formed. Owing to the rotation of the developing sleeve 4 in the opposite direction, the developing agent 3 lying on the developing sleeve 4 is scraped by the end of the mylar plate 10 and is put into the toner containing part 5*b* through the toner supplying hole 5*c*. Since the developing agent 3 within the developing agent drifting part A is carried by the developing sleeve 4 during the retrieve, all the developing agent which has used in the developing machine G can be gathered in the toner containing part 5*b*.

When the retrieve of the developing agent 3 is almost completed, the user rotates the knob 8 further in the right direction so that the arrow of the knob 8 points out the mark "OFF", as shown in FIG. 6(*a*). According to the rotation of the knob 8, the mylar plate 10 is moved to close the toner supplying hole 5*c*. As shown in FIG. 6(*b*), the sensor S2 detects the movement of the mylar plate 10 and, based on a detection result obtained by the sensor S2, the reversible motor is controlled to stop the rotation of the developing sleeve 4. After the completion of the retrieve of the developing agent from the machine to the toner containing part 5*b*, the developing agent storage case 5 is detached from the supporting case 2 and, instead, a new storage case 5 is attached thereto.

As mentioned above, according to the developing machine G in this embodiment, a toner density of the developing agent 3 can be always made less then a given density, and the developing machine G can be constructed small in size and low in cost. Further, since the developing agent 3 can be replaced by a new one simultaneously with the setting of a new toner, the copy machine can generate an image stable and superior in quality. Further, it is possible to evenly set a new developing agent at a place corresponding to a development area by an easy replacement operation of merely attaching the developing agent storage case 5 to the supporting case 2.

Further, according to the developing machine G in this embodiment, the layer thinning projection 5*d* is made new whenever the storage case 5 is replaced by a new one. Accordingly, a gap between the projection 5*d* and the surface of the developing sleeve 4 is not widened by abrasion caused when a layer of the developing agent is thinned. In other words, the replacement of the storage case 5 by a new one prevents the decrease or failure of the function of thinning the layer of the developing agent. Accordingly, an image stable and superior in quality can be always obtained.

Further, according to the developing machine G in this embodiment, a used developing agent is gathered into the toner containing part 5*b* prior to the replacement of the storage case 5, and thereafter the toner supplying hole 5*c* is closed with the mylar plate 10. Accordingly, it is possible to prevent the developing agent from leaking out through the hole 5*c* when the storage case 5 is replaced.

Further, according to the developing machine G in this embodiment, the ON-OFF operation for reversibly driving the developing sleeve 4 is carried out by turning the knob 8. Accordingly, user's simple operations make it possible to retrieve the developing agent certainly.

(Second Embodiment)

Figure 7:
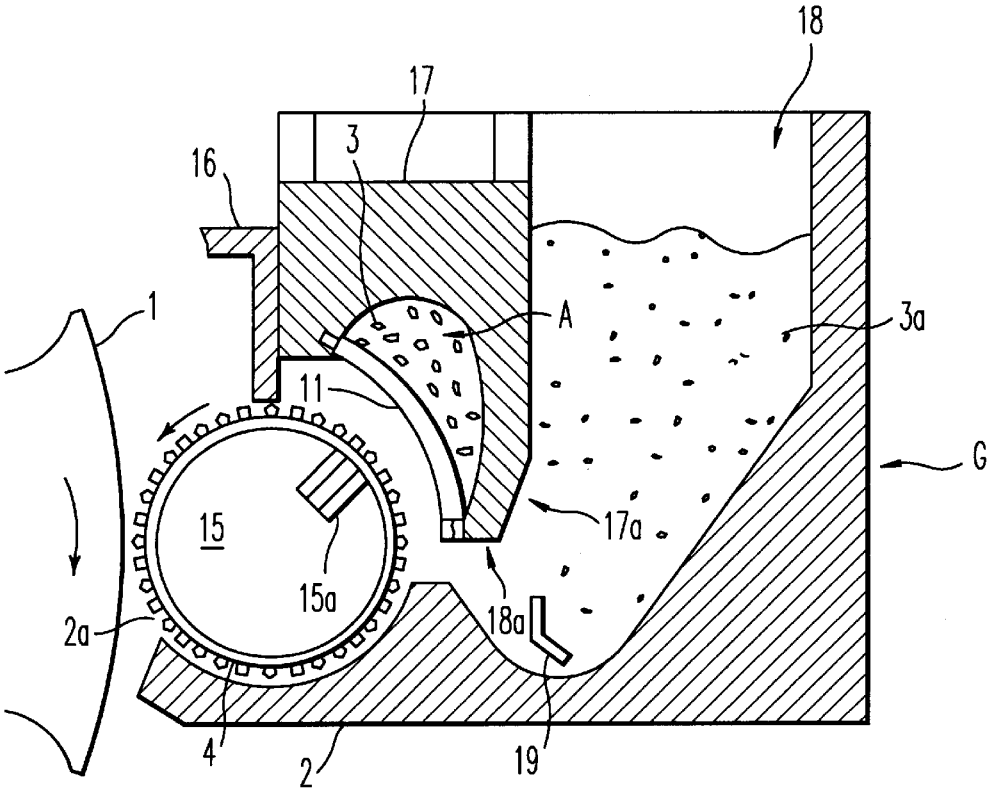
FIG. 7 is a front sectional schematic view of a developing machine according to a second embodiment of the present invention.

FIG. 7 is a partly sectional schematic view of a developing machine according to a second embodiment of the present invention.

The developing machine G is disposed on the lateral side of a cylindrical photosensitive drum 1 which serves as a latent image carrying medium for use in an image forming apparatus.

The developing machine G comprises a supporting case 2, a developing sleeve 4, a magnetic roller 15, a doctor 16, a hood 17, a toner hopper 18, and so on. The supporting case 2 has an opening 2*a* which faces the photosensitive drum 1. The developing sleeve 4 serving as a developing agent carrying medium is partly open to the view from the opening 2*a*. The developing sleeve 4 carries a developing agent 3, which consists of a toner and magnetic particles (referred to as "carrier" in the following), on the surface of the developing sleeve 4. The magnetic roller 15 consists of a group of stationary magnets fastened in the developing sleeve 4. The stationary magnets serve as magnetic field generating means. The doctor 16 serves as a developing agent regulating member for regulating the amount of a developing agent which is carried on the developing sleeve 4. The hood 17 adjacent to the doctor 16 defines a space for containing the developing agent which drifts over the developing sleeve 4. The toner hopper 18 contains a toner. The magnetic polarity of the surface of the magnetic roller 15 is graphically indicated in the developing sleeve 4 shown in FIG. 7.

An end 17*a* of the hood 17 on the upstream side in the direction of rotation of the developing sleeve 4 extends along the developing sleeve 4 with a predetermined space therebetween. The space defined by the hood 17 serves as a developing agent drifting space A for drifting a developing agent which has been stopped by the doctor without reaching a development area opposite to the photosensitive drum 1. A magnetic pole 15*a* of the magnetic roller 15 is mounted inside the developing sleeve 4 opposite to the drifting space A.

The toner hopper 18 has a toner supplying opening 18*a*. The opening 18*a* opposite to the surface of the developing sleeve 4 is contiguous to the drifting space A on the upstream side in a direction in which the developing agent is conveyed. At a place close to the opening 18*a*, a toner stirrer 19 is mounted for stirring and pushing out a toner 3*a* toward the opening 18*a*.

In the developing machine G thus constructed, the toner which has supplied to the side of the developing sleeve 4 through the opening 18*a* by means of the stirrer 19 is attracted to the carrier (magnetic particles) which exists only in the drifting space A. The developing agent 3 which is being carried on the developing sleeve 4 is conveyed in accordance with the rotation of the developing sleeve 4 in the direction of an arrow. The developing agent 3 lying on the developing sleeve 4 is then thinned by the doctor 16. The thinly leveled developing agent 3 is conveyed to a development area which faces the photosensitive drum 1 rotating in the direction of an arrow. In the development area, an electrostatic latent image formed on the photosensitive drum 1 is supplied with the toner so as to make the latent image visible. The remaining developing agent 3 which has not been used for the visualization is conveyed in accordance with the rotation of the developing sleeve 4 and is supplied with a new toner 3*a* pressed out by the stirrer 19 through the opening 18*a*. The developing agent 3 with the new toner 3*a* returns to the drifting space A.

On the other hand, a part of the developing agent 3 which has been stopped by the doctor 16 without reaching the development area is moved toward the opening 18*a* of the toner hopper 18 by gravity and inner pressure caused by the developing agent 3 itself within the drifting space A. The developing agent 3 which has been moved close to the opening 18*a* is conveyed toward the doctor 16 in accordance with the rotation of the developing sleeve 4 so as to circulate in the drifting space A.

Even when a toner density is controlled, the developing agent can circulate therein because room is still left on the upper side thereof At this time, the carrier on the developing sleeve 4 which accompanies the developing sleeve 4 is alternately replaced with the carrier in the drifting space A.

The developing agent in the drifting space A is circulated clockwise under the influence of the restraint of the magnetic pole N imposed on the carrier on the surface of the developing sleeve 4, the influence of the restraint of both the magnetic pole N and the doctor 16 imposed on the carrier in the drifting space A, and the influence of the inner wall of the hood 17 which aids the circulation. The circulation of the developing agent is further influenced by the combination of magnetic force, gravitational force, and frictional force which are given by optionally determining the arrangement of magnetic poles within the developing sleeve 4, the number of magnetic poles, the fluidity of the carrier, magnetic characteristics, and the like.

Figure 8:
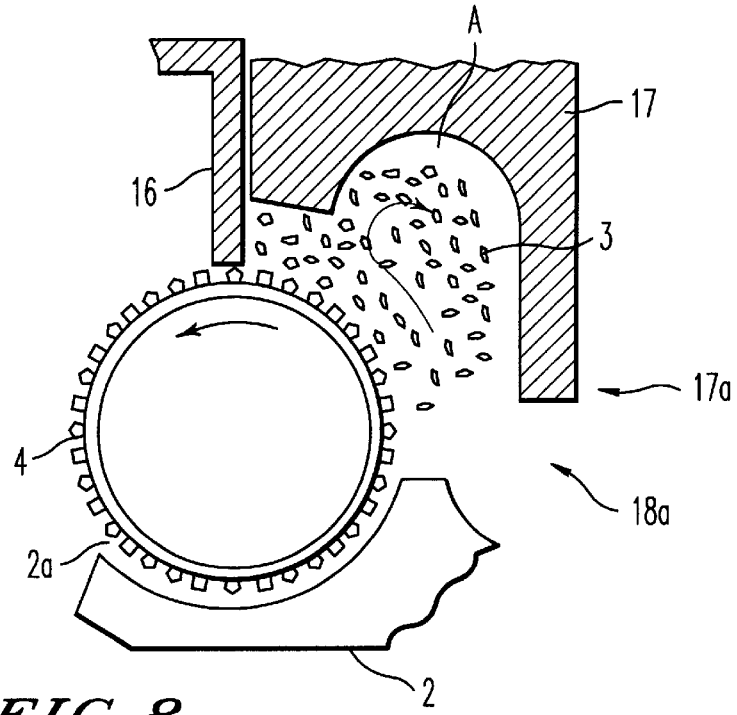
FIG. 8 is an enlarged view of a main part of FIG. 7.

FIG. 8 is an enlarged view of a main part of FIG. 7. As shown in FIG. 7, a shutter 11 is disposed at an opening between the drifting space A and the developing sleeve 4. The opening therebetween is opened and closed with the shutter 11 by, sliding the developing sleeve 4 in the axial direction. The shutter 11 can be drawn out to one side in the axial direction. In addition, the hood 17 with the shutter 11 is detachable from the developing machine G upward. During image formation, the shutter 11 is left detached.

In order to replace the carrier, the shutter 11 is first inserted into the hood 17, and then, with the carrier in the drifting space A, the hood 17 is detached from the machine G upward. In order to put a new carrier into the drifting space A, the shutter 11 is left inserted therein with a new development agent in the machine G. In this state, the hood 17 is attached to the machine G, and thereafter the shutter 11 is drawn out to the predetermined side.

By the way, in order to control a toner density by the use of a carrier small in quantity, there are required an area for sufficiently charging a toner and an area for controlling a toner density both of which are between the hood 17 and the developing sleeve 4. For example, in a conventional developing machine shown in FIG. 9, a hood 12 is constructed such that a toner supplying opening 18*a* is enlarged to smoothly take a toner in for the purpose of the selfcontrol of a toner density. However, according to this construction, situations frequently occur in which a developing agent 3 cannot circulate fluently because a part of the developing agent 3 along the bottom surface of the hood 12 is liable to become an immovable layer. For this reason, only a part of a carrier accompanying a rotating developing sleeve 4 contributes a developing process very frequently and undergoes rapid deterioration in quality. As a result, the life of the carrier is shortened.

In addition, since charge to the toner of the developing agent 3 is carried out only through the pressure chiefly from the surface of the doctor 16, non uniformity of charge on the developing sleeve 4 is liable to partly occur in the axial direction from some causes, such as partial differences in magnetic characteristic of the doctor 16 or differences in application of pressure to the developing agent 3.

Figure 9:
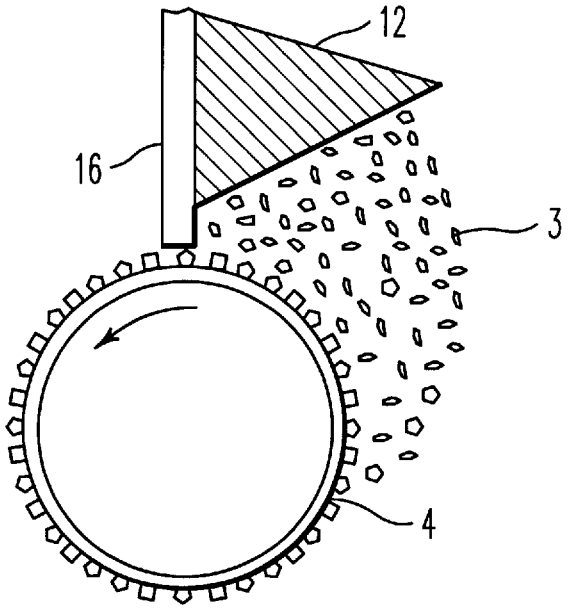
FIG. 9 PRIOR ART
FIG. 9 is a descriptive drawing for explaining how to attach a developing agent retainer of a conventional developing machine to the machine.

In addition, in the developing machine shown in FIG. 9, the rotation moment (torque) of the developing sleeve 4 comes down because a part of the developing agent 3 forms an unmovable layer along the bottom surface of the hood 12 and therefore the remaining agent is liable to concentrate in the vicinity of the doctor 16 and, as a result, the pressure of the unmovable layer is applied to the developing sleeve 4 in the wide range thereof.

In order to overcome the above faults, the inventor of the present invention has studied thoroughly and obtained the following result. That is, a toner can be satisfactorily charged on condition that a distance between the center axis of the developing sleeve 4 and the bottom of a toner charging portion before the doctor 16 ranges from (r+1)mm up to (r+10)mm wherein r is a radius of the developing sleeve 4. Under this condition, the developing agent 3 is regulated by the doctor 16 so as to increase the inner pressure of the toner charging portion and thereafter the toner is charged. Accordingly, a complicated mechanism which is composed of, for example, a paddle, a screw, and the like, is not required for charging and stirring the developing agent.

According to the developing machine G in the second embodiment, the hood 17, which is a component of the machine G, adjacent to the doctor 16 is made a cartridge type to be detachable from the machine body. In addition, by the use of the low-cost shutter 10, the developing agent can be easily replaced.

In addition, a toner density can be fixed within a given range by regulating the amount of carrier by means of a toner density regulating unit. In addition, the developing agent can be certainly charged by applying pressure on the developing agent by means of the toner charging portion in front of the doctor 16.

In addition, the size of the developing machine G can be made much smaller than a conventional developing machine because there is no need of controlling a toner density within the drifting space A in accordance with the amount of carrier and no need of additionally providing the machine with a charging and stirring member, such as a paddle.

In addition, the toner can be evenly charged in the axial direction of the developing sleeve 4 by applying fixed pressure on the developing agent during passage of the developing agent through the toner charging portion. The charged developing agent on the developing sleeve 4 is thinned to a given thickness by means of the doctor 16.

(Embodiment 3)

Figure 10A:
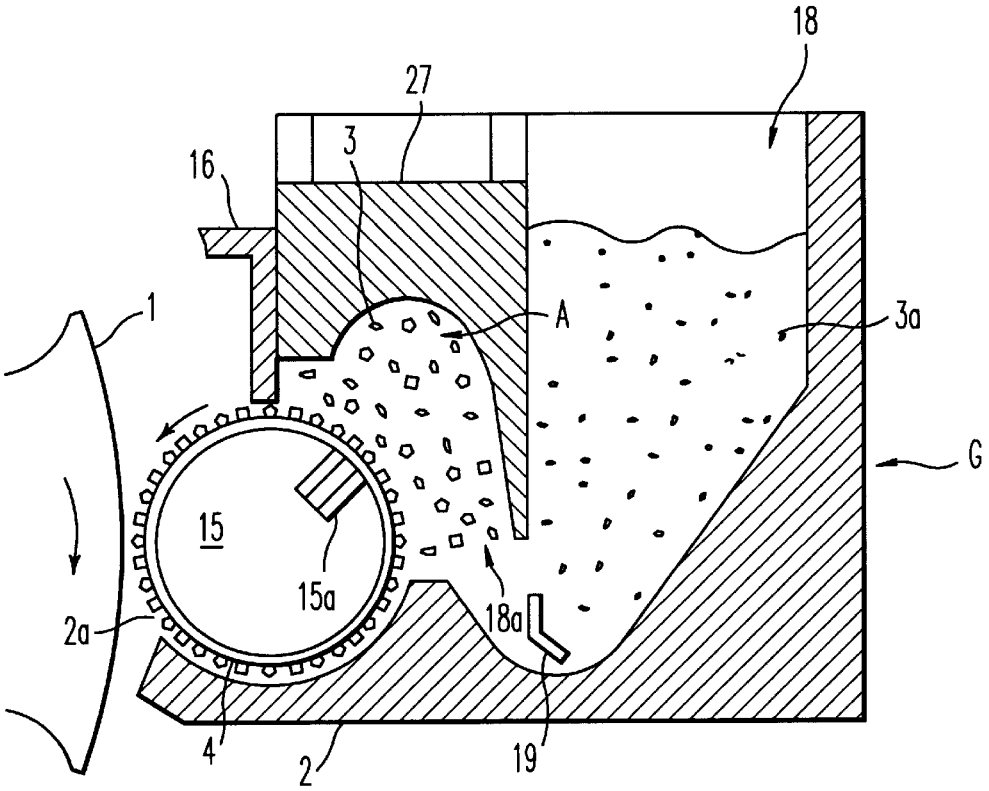
FIG. 10(*a*) is a front sectional schematic view of a developing machine according to a third embodiment of the present invention, and FIG. 10(*b*) is a perspective view of a developing agent storage case of the developing machine of FIG. 10(*a*).
Figure 10B:
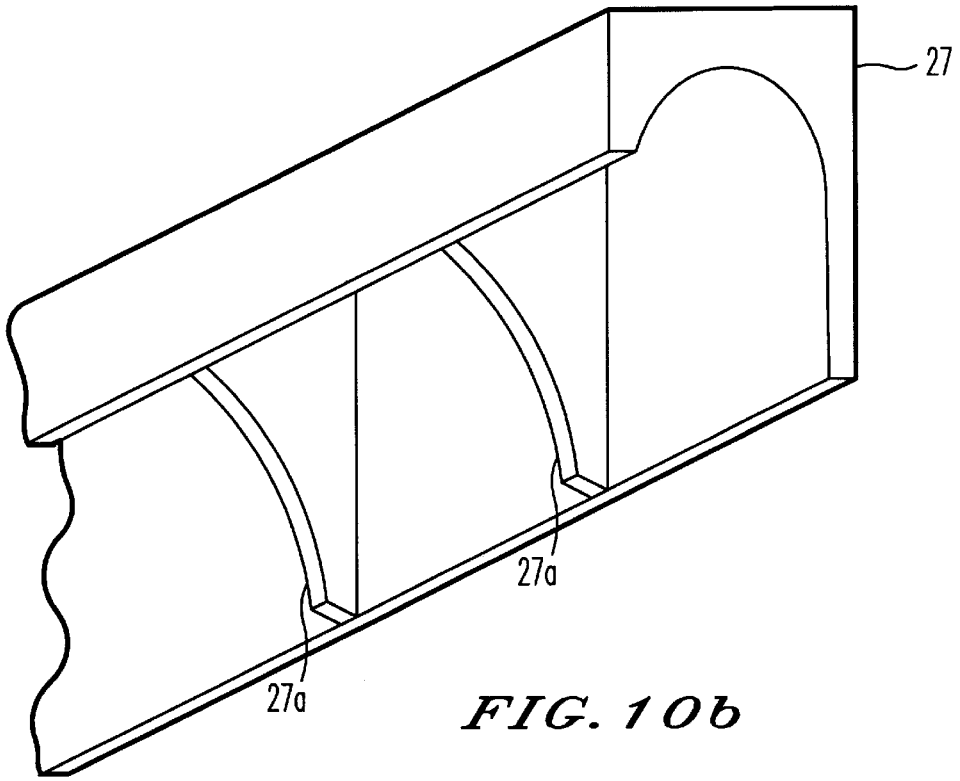

FIG. 10(*a*) is a partially sectional schematic view of a developing machine according to a third embodiment of the present invention.

The developing machine G is disposed on the lateral side of a cylindrical photosensitive drum 1 which serves as an image carrying body. The developing machine G comprises a supporting case 2, a developing sleeve 4, a magnetic roller 15, a doctor 16, a developing agent storage case 27, a toner hopper 18, and so on. The supporting case 2 has an opening 2*a* which faces the photosensitive drum 1. The developing sleeve 4 acting as a developing agent carrying body is partly open to the view from the opening 2*a*. The developing sleeve 4 carries a developing agent 3, which consists of a toner (toner particles) and magnetic particles, on the surface thereof The developing sleeve 4 is made of nonmagnetic substance. The magnetic roller 15 acting as a magnetic field generating means is fastened in the developing sleeve 4. The doctor 16 acts as a developing agent regulating member for regulating the amount of a developing agent which is carried on the developing sleeve 4. The toner hopper 38 contains a toner.

Between the developing agent storage case 27 and the developing sleeve 4, the storage case 27 defines a developing agent drifting space A for drifting a developing agent which has been stopped by the doctor 16 without reaching a development area opposite to the photosensitive drum 1. A magnetic pole 15*a* of the magnetic roller 15 is mounted inside the developing sleeve 4 opposite to the drifting space A.

The toner hopper 18 has a toner supplying opening 18*a*. The opening 18*a* opposite to the surface of the developing sleeve 4 is contiguous to the drifting space A on the upstream side in a direction in which the developing agent is conveyed. At a place on the supporting case 2 close to the opening 18*a*, a toner stirrer 19 is mounted for stirring and pushing out a toner 3*a* toward the opening 18*a*.

As shown in FIG. 10(*b*), ribs 27*a* are formed on the inner surface of the developing agent storage case 27. In an area of the drifting space A in which a flux density of a magnetic field in a direction of a normal of the surface of the developing sleeve 4 is less than a predetermined value, in other words, in an area thereof in which the maintaining force of the magnetic field with respect to the developing agent 3 is weak, the rib 27*a* acts as a developing agent guiding member for guiding the developing agent 3 while restraining the movement of the developing agent 3 within the storage case 27 in a direction (referred to as "longitudinal direction" in the following) perpendicular to a direction in which the developing agent is conveyed. The ribs 27*a* are equally spaced out in the longitudinal direction so that a developing agent same in quantity can be contained in each space between the ribs 27*a*. The height of the rib 27*a* is determined in accordance with the amount of the developing agent in the drifting space A. For example, if it is required to lower the inner pressure of the developing agent and lessen the amount of charge of the toner by the decrease of the developing agent within the drifting space A, the rib 27*a* is heightened to reach the developing agent.

On the other hand, a part of the developing agent 3 which has been stopped by the doctor 16 without reaching the development area is moved toward the opening 18*a* of the toner hopper 18 by gravity and inner pressure caused by the developing agent 3 itself within the drifting space A. The developing agent 3 which has been moved close to the opening 18*a* is again conveyed toward the doctor 16 in accordance with the rotation of the developing sleeve 4 so as to circulate in the drifting space A.

In the developing machine G thus constructed, as a toner density becomes higher by additionally supplying the developing agent 3 with a toner, the volume of the developing agent 3 increases. Accordingly, the developing agent 3 gradually proceeds to the opening 18*a* so as to close the opening 18*a* therewith. For this reason, a toner to be taken in the developing agent 3 lying on the developing sleeve 4 decreases in quantity. This makes it possible to always maintain the toner density of the developing agent 3 at a level less than a given density. In contrast, as a toner density of the developing agent 3 becomes lower, the volume of the developing agent 3 decreases. Accordingly, since the developing agent 3 closing the opening 18*a* flows away from the opening 18*a*, a given amount of toner is taken in the developing agent 3 on the developing sleeve 4 so as to maintain the toner density of the developing agent 3 at a predetermined level. Since a toner density can be controlled within an almost fixed range, as described above, there is not required a complicated toner density controlling mechanism which includes a toner sensor, a toner supplying member, and the like.

Further, in the developing machine G, the ribs 27*a* formed on the inner surface of the storage case 27 regulates the movement of the developing agent 3 in the longitudinal direction in an area in which the maintaining force of the magnetic field with respect to the developing agent 3 is weak. Accordingly, the inclination or tremble of the developing machine G does not cause the concentrical gathering of the developing agent 3 round only one place in the longitudinal direction.

If a flux density of a magnetic field in the direction of the normal of the surface of the developing sleeve 4 is more than 50 G(gauss), the developing agent 3 can be maintained by magnetic force. Accordingly, the rib 27*a* can be extended from the inner surface of the storage case 27 to a position up to which a flux density more than 50 G exists.

Figure 11:
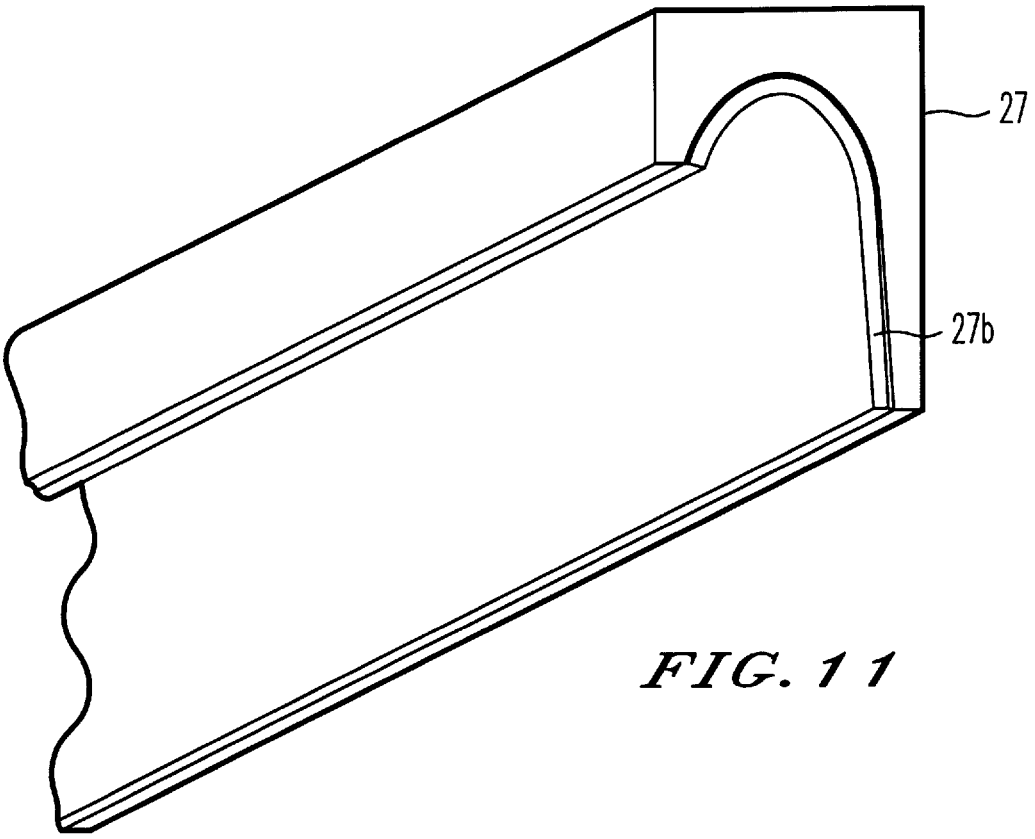
FIG. 11 is a perspective view of a developing agent storage case according to a modification of the present invention.

In the third embodiment, the ribs 27*a* are formed on the inner surface of the storage case 27. Instead, such a construction as shown in FIG. 11 may be adopted. In this construction, a magnetic substance 27*b* is attached to the inner surface of the storage case 27, and the magnetic pole 15*a* of the magnetic roller 15 opposite to the magnetic substance 27*b* is mounted inside the developing sleeve 4. The magnetic substance 27*b* is magnetized by a magnetic field generated from the magnetic pole 15*a*, and thereby the magnetic field is converged on an area close to the inner surface of the storage case 27 which is widely apart from the developing sleeve 4 so as to strengthen magnetic force in the direction of the normal of the surface of the developing sleeve 4 relative to the developing agent 3. As a result, the magnetic force can be exerted on the whole drifting space A, and therefore the maintaining force of the magnetic force acts on all the developing agent 3 within the drifting space A. Therefore, even when the developing machine G is tilted or shaken, the developing agent 3 does not gather only to one side in the longitudinal direction.

Figure 12:
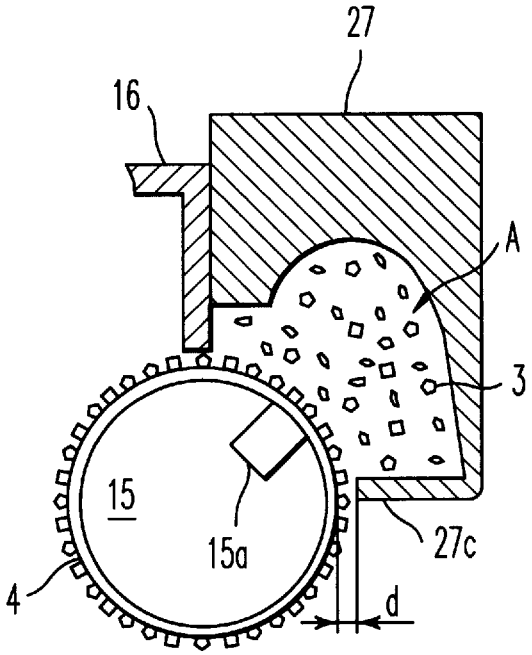
FIG. 12 is a partly sectional schematic view of a main part of a developing machine which includes a developing agent storage case according to another modification of the present invention.

Another construction shown in FIG. 12 may be adopted. In this construction, an end 27*c* of the storage case 27 on the side of the opening 18*a* is bent toward the center of the developing sleeve 4 so as to make a gap of a predetermined short distance d between the extremity of the end 27*c* and the surface of the developing sleeve 4. The whole drifting space A can be closely filled with the developing agent 3. According to this construction, since the developing agent 3 filling the drifting space A does not escape from the gap, the amount of the developing agent 3 within the drifting space A can be maintained at a level according to which the developing agent 3 does not gather to one locality in the longitudinal direction.

Accordingly, the inclination or tremble of the developing machine G does not bring about the movement of the development agent 3 within the drifting space A, and therefore localization of the development agent in the longitudinal direction does not occur. This advantage can be enhanced in proportion to the total amount of the developing agent 3 within the drifting space A.

Preferably, the distance A between the extremity of the end 27*c* and the developing sleeve 4 is within a range of 0.1 mm to 3 mm. If the distance d is set close to the minimum (0.1 mm) within the range, an amount of toner which passes through the gap and is taken in the developing agent 3 decreases, and thereby a toner density is set low. In contrast, if the distance d is set close to the maximum (3 mm) within the range, an amount of toner which passes through the gap and is taken in the developing agent 3 increases, and thereby a toner density is set high. According to this construction, since an amount of toner to be taken in is varied in accordance with the variation of the volume of the developing agent, a toner density of the developing agent can be controlled within a predetermined range centering the set value.

In the third embodiment, the magnetic roller 15 is fastened in the developing sleeve 4, and the developing agent is kept on the surface of the developing sleeve 4 by magnetic force and is conveyed by rotating the developing sleeve 4. However, the present invention is also applicable to a structure in which the developing sleeve 4 is fixedly mounted and, by rotating the magnetic roller 15, the developing agent 3 is kept on the developing sleeve 4 by magnetic force and is conveyed.

(Fourth Embodiment)

Figure 13:
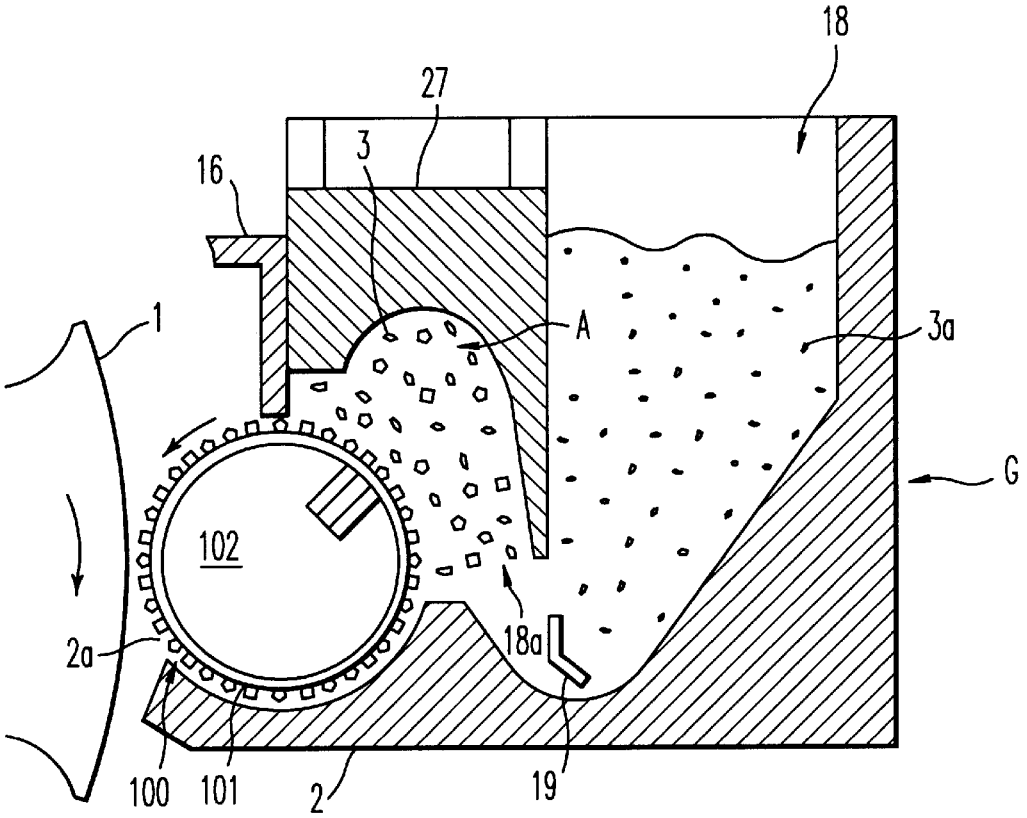
FIG. 13 is a partly sectional schematic view of a developing machine according to a fourth embodiment of the present invention.

FIG. 13 is a partly sectional schematic view of a developing machine according to a fourth embodiment of the present invention. Since the whole construction of the developing machine G in the fourth embodiment is similar to that in the third embodiment (see FIG. 10), a description thereof is omitted. However, reference numeral 100 is given to the developing roller, 101 is given to the developing sleeve, and 102 is given to the magnetic roller in this embodiment.

Figure 14:
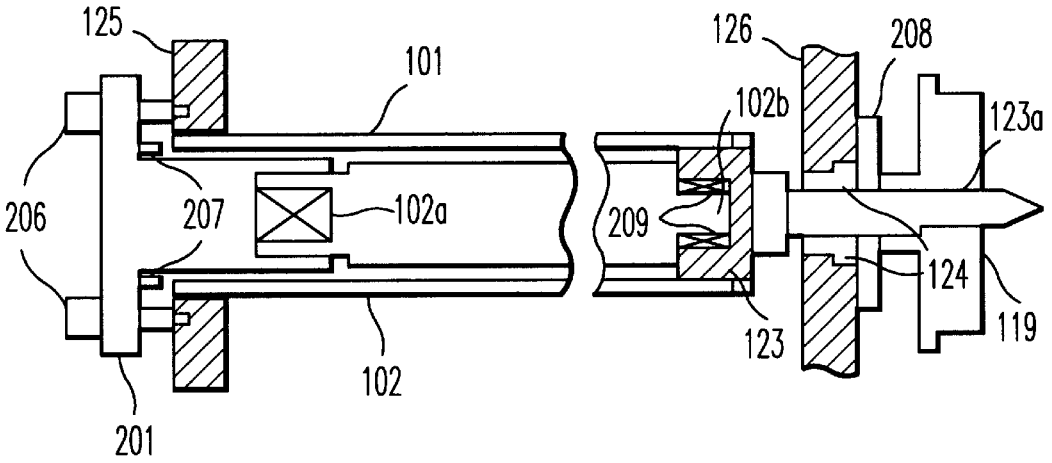
FIG. 14 is a sectional view of components which support a developing roller of the developing machine of FIG. 13.

FIG. 14 is a sectional view of components which support the developing roller 100 of the developing machine G of FIG. 13.

First of all, supporting members on the side of a rear side plate 126 will be described with reference to FIG. 14. A shaft 123*a* of a flange 123 is pressed in a right-hand hole of the developing sleeve 101. The shaft 123*a* is fixed to the rear side plate 126 through a bearing 124. A driving member, such as a gear, for communicating driving force to the developing sleeve 101 is attached to in outer end of the shaft 123*a*. A gap roller 208 is mounted between the rear side plate 126 and the driving member 119. Shafts 102*a*, 102*b* are mounted on both the ends of the magnetic roller 102, respectively. The rear shaft 102*b* is attached to the flange 123 through a bearing 209.

Figure 22:
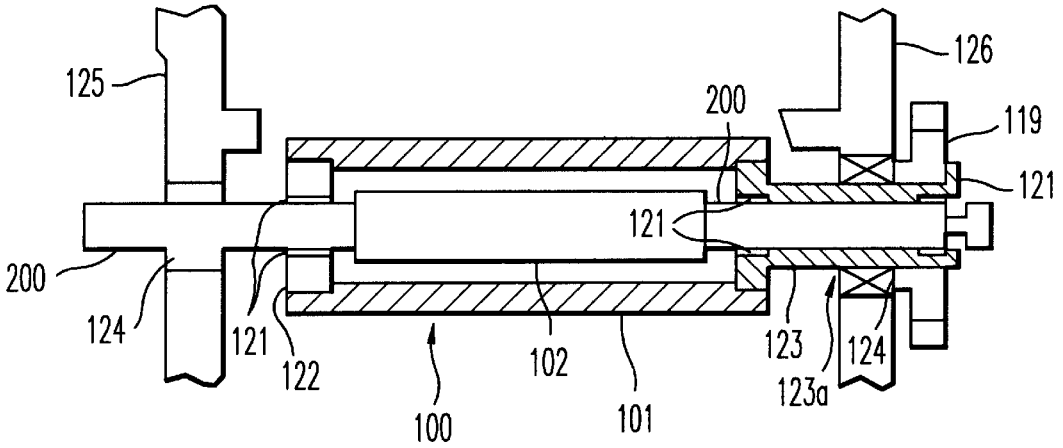
FIG. 22 PRIOR ART
FIG. 22 is a sectional view of developing roller supporting parts of a conventional developing machine.
Figure 23:
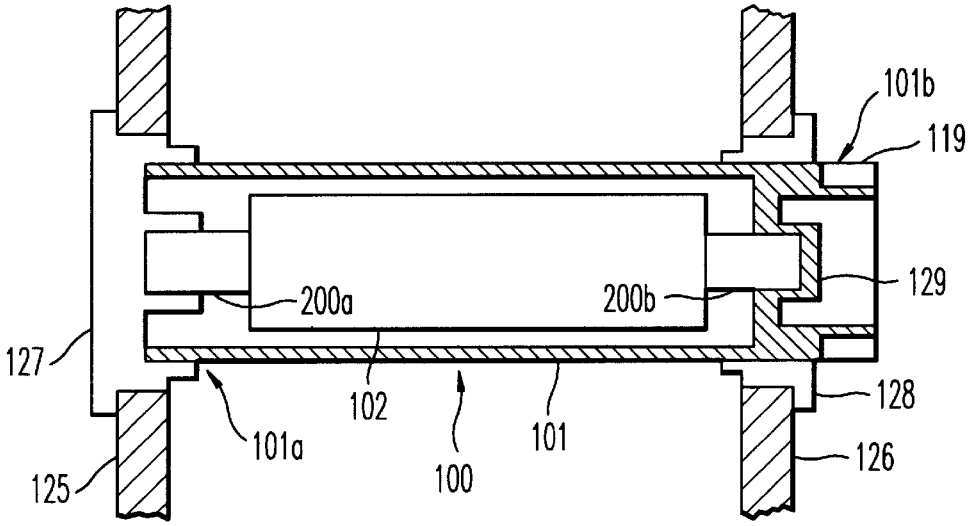
FIG. 23 PRIOR ART
FIG. 23 is a sectional view of developing roller supporting parts of another conventional developing machine.

Next, a supporting member 201 on the side of a front side plate 125 will be described. A supporting part smaller in diameter than the developing sleeve 101 rotatable supports the developing sleeve 101 from the inside and positions an axis of the developing sleeve 101. As shown in FIG. 14, before the front side plate 125, the supporting member 201 has a collar part larger in diameter than the through-hole of the front side plate 125. The supporting member 201 is fastened to the front side plate 125 by means of stepped screws 206 each of which passes through a hole formed in the collar part and is driven into the front surface of the front side plate 125. The supporting member 201 can be easily drawn out of the developing sleeve 101 by removing the stepped screws from the supporting member 201. In addition, according to the construction in which the sleeve supporting portion and the attaching portion are formed integrally with each other, a flange is not required, and thus manufacturing costs can be reduced. In addition, the direct attachment of the supporting member to the machine narrows an unnecessary space between the developing sleeve and the side plate in comparison with the conventional machine shown in FIG. 22, and thus the machine can be made smaller in size than hitherto.

In the developing machine G according to the fourth embodiment, in order to mount the magnetic roller 102 in the developing sleeve 101 fixedly, the shaft 102*a* of the magnetic roller 102 is milled and cut D-shaped, and a hole 201*a* for engaging the shaft 102*a* with the supporting member 201 is formed in the inside end of the supporting member 201. When the magnetic roller 102 is attached to the machine, the hole 201*a* is engaged with the shaft 102*a* and, at the same time, positions the magnetic pole of the magnetic roller 102 in a rotational direction in a state in which the supporting member 201 itself is fastened to the front side plate 125 by means of the stepped screws 206. Accordingly, since a member for positioning the magnetic roller 102 can be omitted, manufacturing costs go down in comparison with a situation in which the positioning member is required.

As a material of the supporting member 201, a coppery sintered material which includes oil (see JIS SKB 1218, for example) or a resinous material for a slide bearing can be used to smoothly slide the magnetic roller 102 on a bearing.

A modification of the supporting member 201 will now be described with reference to FIG. 15. A modified supporting member 201 also rotatably supports the front end of the developing sleeve 101 from the inside and fixedly supports the magnetic roller 102 in the developing sleeve 101.

Figure 15:
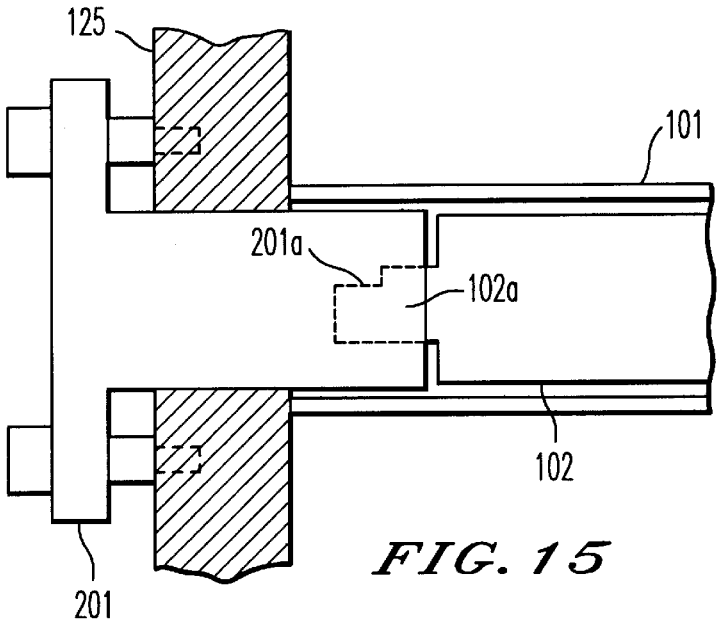
FIG. 15 is a sectional view of a modification of the supporting part of the developing roller.

In FIG. 15, the right-hand half of the developing roller 100 is omitted. The sleeve supporting member 201 is fixed to the left-hand end of the developing sleeve 101 as in FIG. 14. In the developing sleeve 101, the shaft 102*a* of the magnetic roller 102 is engaged with the hole 201*a*. It this modification, the through-hole formed in the front side plate 125, for attaching the supporting member 201 to the developing sleeve 101 is made smaller in diameter than the developing sleeve 101, and the developing sleeve 101 is positioned in the direction at the axis by bringing the end of the developing sleeve 101 into contact with the front side plate 125.

Generally, the positioning accuracy of the axis of the developing sleeve 101 is heightened in proportion to an amount of insertion of the supporting member 201 into the developing sleeve 101. However, in the construction in which the front side plate 125 is brought into contact with the end of the developing sleeve 101, an amount of insertion of the supporting member 201 thereinto decreases by the thickness of the front side plate 125 in comparison with that shown in FIG. 14 if the length of the supporting member 201 in the axial direction is fixed. In contrast, in order to insert the supporting member 201 into the developing sleeve 101 by the same amount as in FIG. 14, the supporting member 201 must be lengthened in the axial direction by the thickness of the front side plate 125. Accordingly, the construction shown in FIG. 14 is preferable to that shown in FIG. 15 for the purpose of making the size of the machine small and positioning the axis of the developing sleeve 101 with high accuracy.

(Fifth Embodiment)

Figure 16:
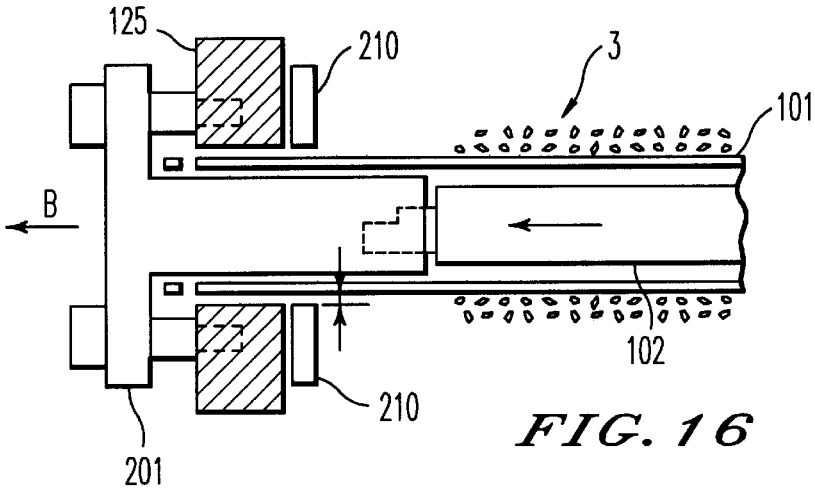
FIG. 16 is a sectional view of a developing roller supporting part of a developing machine according to a fifth embodiment of the present invention, in which a magnetic substance is disposed in the vicinity of the supporting part.

FIG. 16 is a partly sectional view of a developing roller supporting portion of a developing machine according to a fifth embodiment of the present invention. In this machine, it is prevented that the developing agent 3 lying on the developing sleeve 101 drops down from the machine or adheres to the magnetic roller 102 when the magnetic roller 102 is drawn out of the developing sleeve 101. The developing machine G including the supporting member 201, etc., shown in FIG. 16 is constructed in almost the same manner as in FIGS. 13 and 14.

Figure 17:
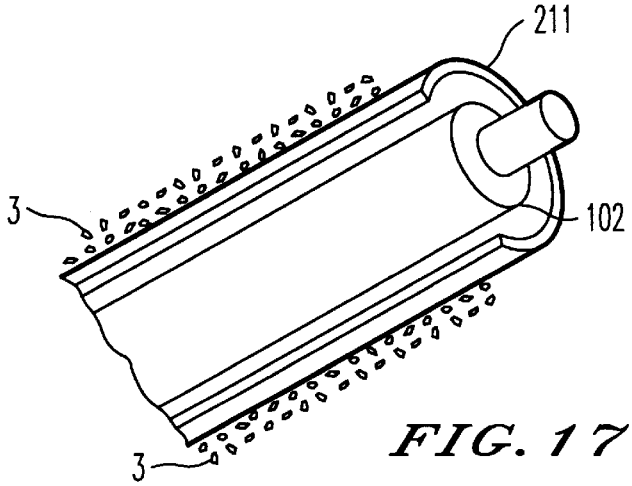
FIG. 17 is a perspective view of a magnetic roller provided with a detachable sheet according to a modification of the developing machine of FIG. 16.
Figure 24A:
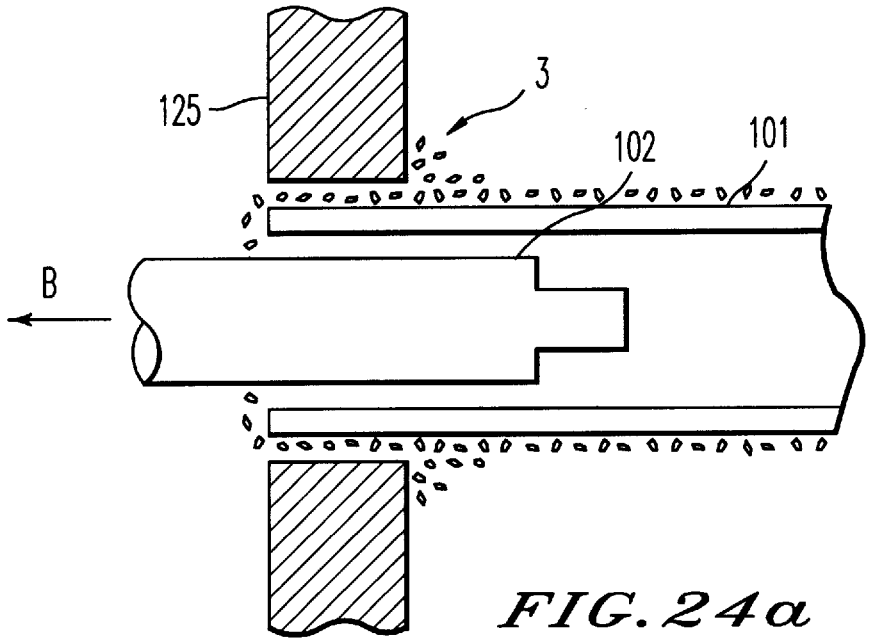
FIG. 24a PRIOR ART
FIGS. 24(*a*) and 24(*b*) are each a descriptive drawing for explaining a disadvantage of a conventional developing machine.
Figure 24B:
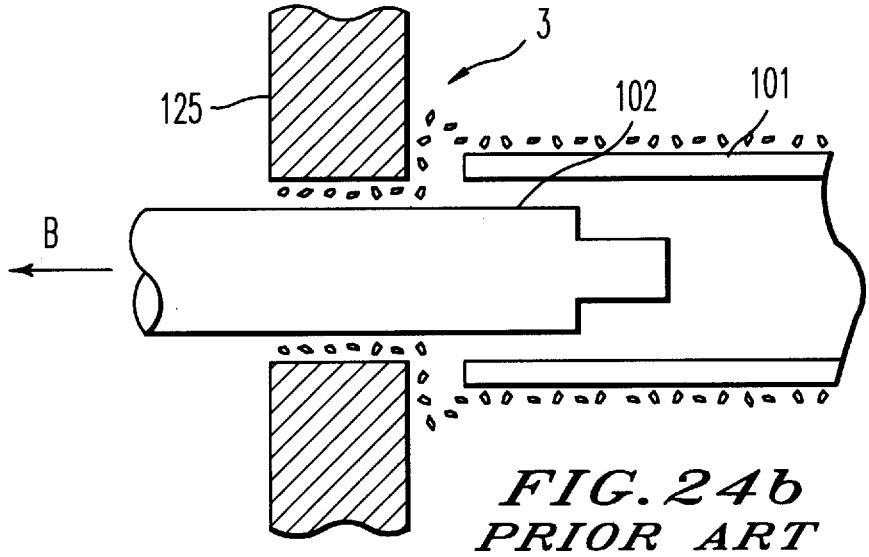
FIG. 24b PRIOR ART

In the fifth embodiment, a magnetic substance 210 is mounted 0.5 mm to 2.0 mm apart from the developing sleeve 101 inside the front side plate 125 having the through-hole through which the magnetic roller 102 is drawn out. (For example, the magnetic substance 210 is glued to the inner surface of the front side plate 125.) When the magnetic roller 102 is drawn out in the direction of arrow B, a magnetic field is generated between the magnetic substance 210 and the magnetic roller 102, and thereby the developing agent 3 is held. Accordingly, the developing agent G is prevented from dropping down through the hole of the front side plate 125 to the outside or adhering to the magnetic roller 102 when the magnetic roller 102 is drawn therefrom. This is different from the situation described with reference to FIG. 24(*a*). In the fifth embodiment, as shown in, for example, FIG. 17, a separable sheet 211 may be mounted on the outer surface of the magnetic roller 102 so that the developing agent 3 adhering to the sheet 211 can be removed together with the sheet 211 when the magnetic roller 102 is drawn therefrom.

Figure 18A:
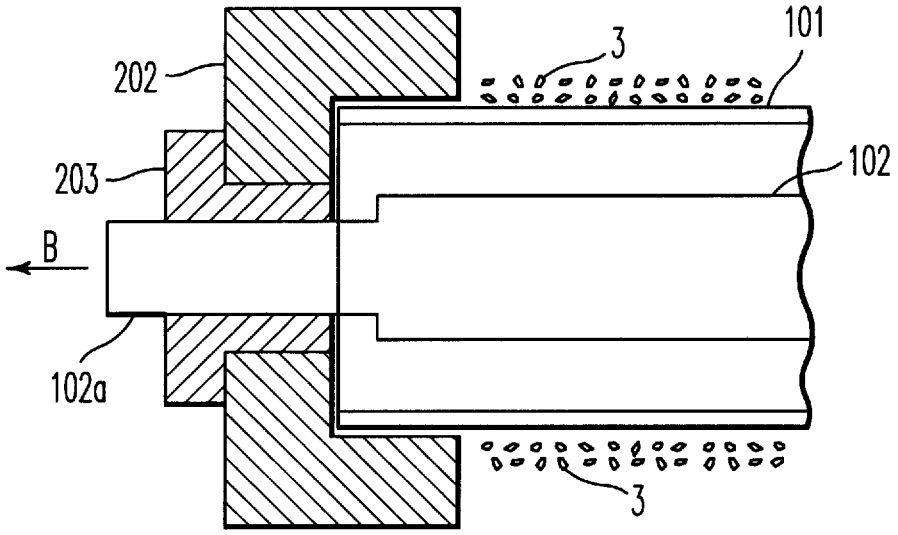
FIGS. 18(*a*) and 18(*b*) are each a sectional view of a developing roller supporting part according to a modification of the developing machine of FIG. 16.
Figure 18B:
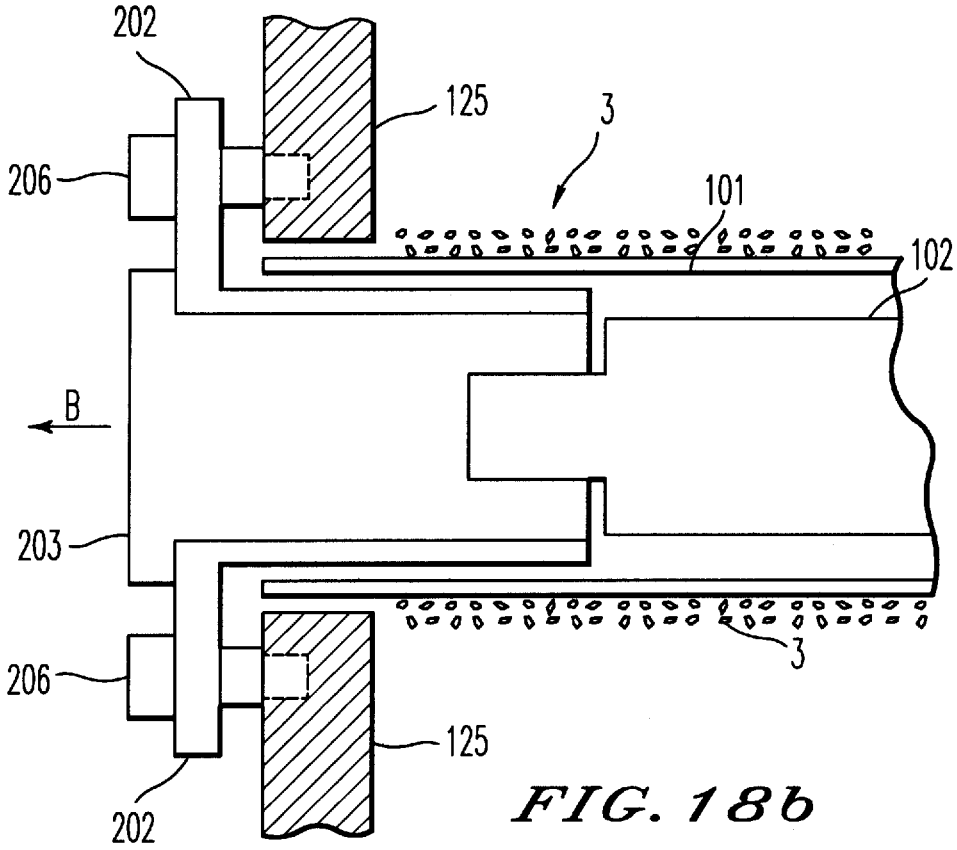

The disadvantage brought about when the magnetic roller 102 is drawn out can be overcome by reforming the shape of the supporting member 201. In FIG. 18(*a*), a developing sleeve supporting member 202 supports the end of the developing sleeve 101 by means of a hollowed part thereof larger in diameter than the developing sleeve 101.

In addition, a through-hole is formed in a part of the supporting member 202 outer than the supported end of the developing sleeve 101. The diameter of the through-hole is smaller then that of the developing sleeve 101 and is larger than that of the magnetic roller 102. The shaft 102*a* of the magnetic roller 102 is inserted in a hole formed in a magnetic roller supporting member 203 which is fit in the through-hole of the supporting member 202 from the outside.

According to this construction, the magnetic roller 102 can be drawn out of the developing sleeve 101 by removing the magnetic roller supporting member 203. When drawn out, the developing agent 3 adhering to the developing sleeve 101 can be prevented from dropping down from the machine because the developing agent 3 is blocked by the developing sleeve supporting member 202 larger in diameter than the developing sleeve 101.

In FIG. 18(*b*), a developing sleeve supporting member 202 which has a similar advantage to that described with reference to FIG. 16 or FIG. 18(*a*) serves to support the developing sleeve 101 from the inside. A supporting part of the supporting member 202 within the developing sleeve 101 is formed tubular. The wall of the supporting part is thinner than a distance between the inner surface of the developing sleeve 101 and the outer surface of the magnetic roller 102. A hollow of the supporting part acts as a through-hole larger in diameter than the magnetic roller 102. A collar part of the supporting member 202 is fastened to the front side plate 125 by means of stepped screws 206 as in FIG. 14. A magnetic roller supporting member 203 fit in the through-hole of the supporting member 202 from the outside has a D-shaped milled cut with which the shaft 102*a* of the magnetic roller 102 is engaged.

According to the construction shown in FIG. 18(*b*), the magnetic roller 102 can be drawn out of the developing sleeve 101 by removing the magnetic roller supporting member 203. When drawn out, the developing agent 3 adhering to the developing sleeve 101 can be prevented from dropping down from the machine because the developing agent 3 is blocked by the collar part of the developing sleeve supporting member 202.

(Sixth Embodiment)

Figure 19:
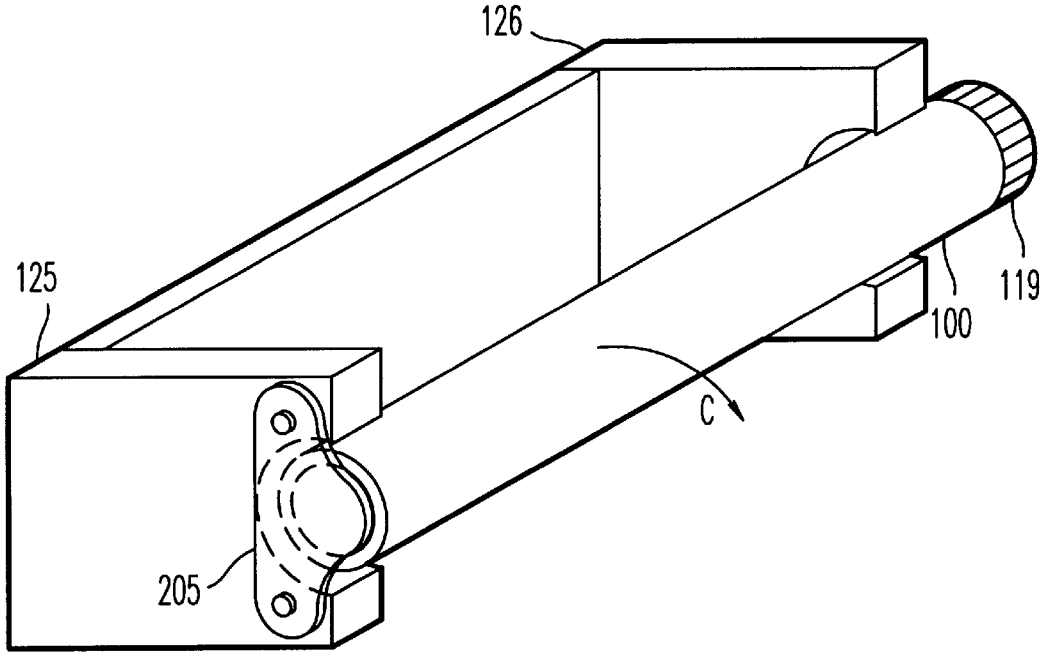
FIG. 19 is a perspective view of developing roller supporting members of a developing machine according to a sixth embodiment of the present invention.

FIG. 19 is a perspective view of a developing roller and developing roller supporting members of a developing machine according to a sixth embodiment of the present invention. The developing machine G is constructed to remove the developing roller by another removing method. In FIG. 19, a driving member 119 is mounted on an end or the developing roller 100. The other end thereof is supported by, a supporting member 205 of which a collar part is fastened to a front side plate 125 by means of stepped screws. Rounded indentations are formed in the front and rear side plates 125, 126, respectively, perpendicular to the axial direction of the developing roller 100. Each of the rounded indentations is wide enough for the developing roller 100 to enter thereinto and move therethrough. Accordingly, the developing roller 100 can be taken off in the direction of arrow C by detaching the supporting member 205 from the front side plate 125.

(Seventh Embodiment)

Figure 20:
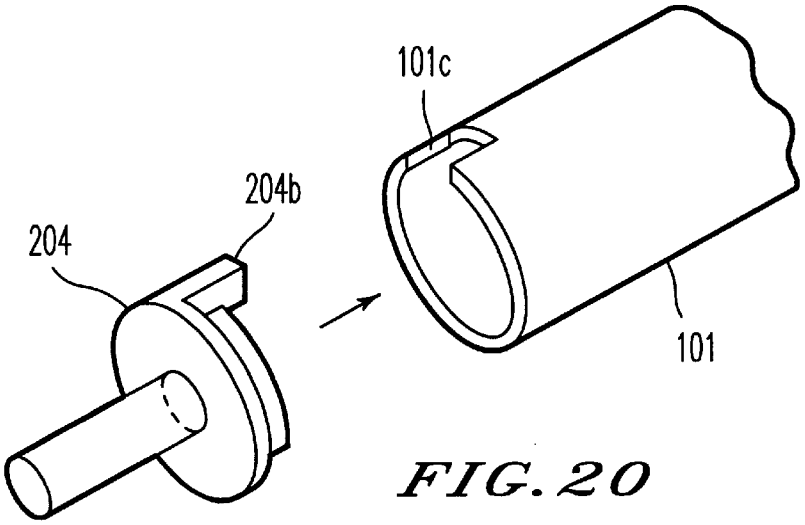
FIG. 20 is a perspective view of a flange acting as a developing roller supporting member and a developing sleeve of a developing machine according to a seventh embodiment of the present invention.

FIG. 20 is a perspective view of a developing roller supporting portion of a developing machine according to a seventh embodiment of the present invention. The developing machine G includes a flange 204 easily detachable from a developing sleeve 101. An indentation 101*c* is formed in an end of the developing sleeve 101. On the other hand, a projection 204*b* with which the indentation 101*c* is engaged is formed on the flange 204 to be attached to the end of the developing sleeve 101. The engagement of the projection 204*b* with the indentation 101*c* leads to the restraint of circumferential rotation of the developing sleeve 101. A to-be-inserted part of the flange 204 other than the projection 204*b* has a diameter same as the inner diameter of the developing sleeve 101 or less than the inner diameter thereof within a range of 0.03 mm. The other part of the flange 204 has a diameter same as the outer diameter of the developing sleeve 101. According to construction, the flange 204 and the developing sleeve 101 can be easily attached to or detached from each other.

Figure 21:
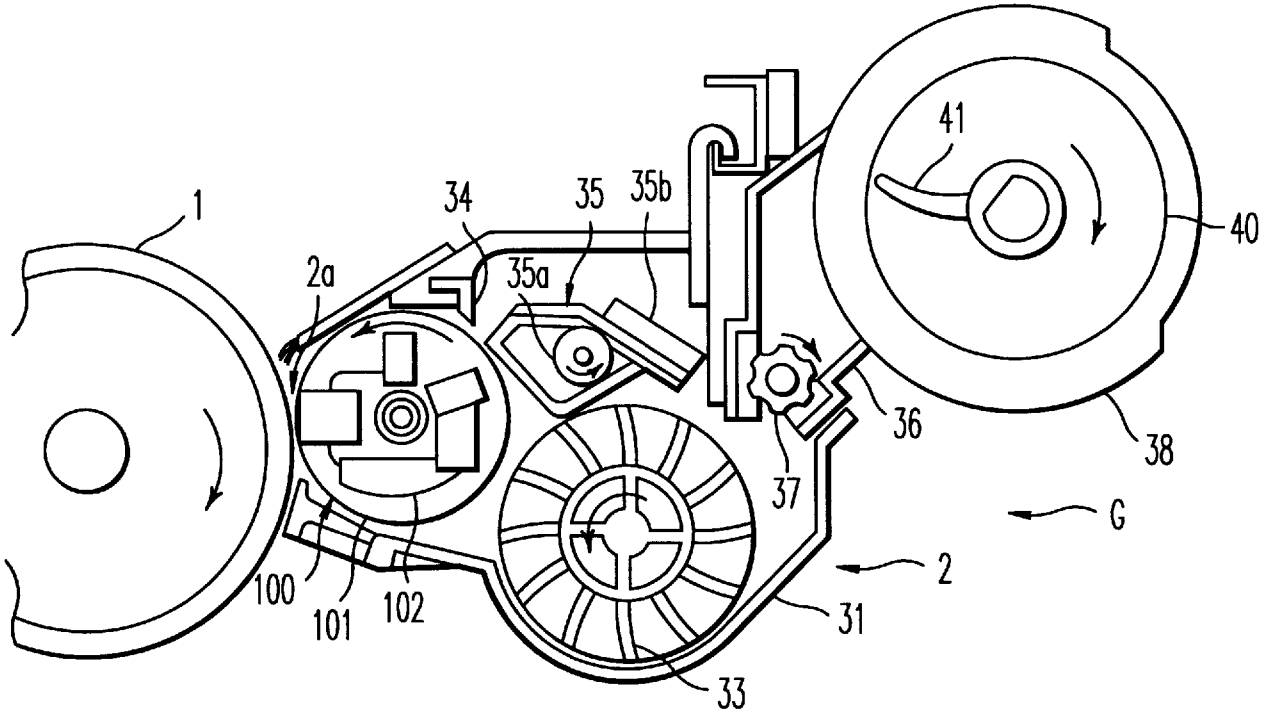
FIG. 21 is a partly sectional schematic view of a developing machine according to another embodiment of the present invention.

The arrangement of the supporting members, etc., of the developing roller in the fourth to seventh embodiments is applicable to a developing machine G shown in FIG. 21, and thereby similar advantages can be obtained. As shown in FIG. 21, the developing machine G is dispensed on the right-hand side of a photosensitive drum 1 acting as a latent image carrying body. Around the photosensitive drum 1, there are disposed a known charging machine, an exposure optical system, a transfer separation machine, a cleaning machine, and an electricity removing machine (each not shown) in order to conduct an electrophotographic process.

The developing machine G consists of a supporting case 2 opposite to the surface of the photosensitive drum 1 on which an electrostatic latent image is formed by the exposure optical system, and a cylindrical toner cartridge 40 acting as a toner container which is attached to the supporting case 2.

The supporting case 2 comprises a casing 31, a developing roller 100, a stirring roller 33, a doctor 34, and a separator 35. The casing 31 has an opening 2*a* facing the surface of the photosensitive drum 1. A part of the developing roller 100 is exposed to the view through the opening 2*a*. The stirring roller 33 serves to give a two-component developing agent, which consists of a toner and a carrier, to the surface of the developing roller 100 and stir the developing agent within the casing 31. The doctor 34 acts as a means for regulating the amount of the developing agent given to the developing roller 100 by the stirring roller 33. The separator 35 can guide the developing agent which is flowing to the lower part of the casing 31 because of the doctor 34. On the separator 35, a conveying screw 35*a* and stirring separator 35*b* are mounted for stirring the developing agent in a direction of an axis of the photosensitive drum 1. At the right upper part of the casing 31, a hopper 36 is disposed in which a toner to be supplied to the casing 31 for replenishment is temporarily stored. A toner supplying roller 37 is disposed in an opening of the hopper 36 facing the casing 31. On an upper opening of the hopper 36, a holder 38 is mounted by which the toner cartridge 40 is detachably, supported.

The holder 38 has a cylindrical hollow part slightly larger than the external shape of the toner cartridge 40. The toner cartridge 40 has an opening (not shown) through which a toner is discharged, and an agitator 41 within. The toner supplying roller 37 and the agitator 41 are rotated by driving force communicated from a main body of the machine. The developing roller 100 comprises, for example, a cylindrical developing sleeve 101 and a magnetic roller 102 within the developing sleeve 101. The magnetic roller 102 acting as a magnetic field generating member has a plurality of magnetic poles.

What is claimed is:

1. A developing machine comprising:

a developing agent carrying medium for carrying a developing agent on a surface thereof, the developing agent consisting of toner particles and magnetic particles;

a supporting case for including and supporting said developing agent carrying medium;

magnetic field generating means disposed within said developing agent carrying medium;

a developing agent regulating member by which an amount of the developing agent carried on said developing agent carrying medium is regulated;

a drift portion having a predetermined capacity, within which the developing agent stopped by said developing agent regulating member drifts; and a toner containing portion having an opening through which a toner is supplied, the opening being contiguous to said drift portion on an upstream side of a direction in which the developing agent is carried and facing said developing agent carrying medium;

said developing machine further comprising:

a developing agent container including said drift portion and said toner containing portion, said developing agent container being attachable to and detachable from said supporting case; and developing agent retrieving means for scraping off and retrieving the developing agent carried on said developing agent carrying medium so as to put the scraped developing agent into said toner containing portion.

2. A developing machine as recited in claim 1, wherein a part of said developing agent container is used as said developing agent regulating member.

3. A developing machine as recited in claim 1, wherein said developing agent retrieving means comprises:

developing agent carrying medium driving means for moving the surface of said developing agent carrying medium in a direction opposite to a direction in which the surface of said developing agent carrying medium is moved during image formation;

a developing agent guiding member for guiding the developing agent carried on said developing agent carrying medium to said toner containing portion, said developing agent guiding member being moved between a contact point where said developing agent guiding member comes in contact with said developing agent carrying medium and a given point apart from the contact point;

developing agent guiding member driving means for driving said developing agent guiding member.

4. A developing machine as recited in claim 3, wherein said developing agent guiding member driving means comprises:

an operating member for retrieve, operable by a user; and a connecting member through which said operating member for retrieve is connected to said developing agent guiding member so as to move said developing agent guiding member in accordance with operation of said operating member for retrieve.

5. A developing machine as recited in claim 3 or 4, wherein said developing agent guiding member is movable from said contact point to a point where said opening through which a toner is supplied is closed with said developing agent guiding member.

6. A developing machine as recited in claim 3 or 4, further comprising:

movement detecting means for detecting movement of said developing agent guiding member; and control means for controlling said developing agent guiding member driving means on the basis of a detection result obtained by said movement detecting means.

7. A developing machine comprising:

a developing device, said developing device including a developing agent carrying medium facing a latent image carrying medium, said developing agent carrying medium rotationally carrying a developing agent which consists of toner particles and magnetic particles and including a magnetic field generating means, wherein a layer of the developing agent is formed on said developing agent carrying medium, and the magnetic particles in the layer of the developing agent are circularly moved in the layer such that the magnetic particles are upwardly moved in a direction in accordance with a rotation of said developing agent carrying medium whereas the toner particles are downwardly moved in accordance with the rotation of said developing agent carrying medium in an opposite direction, thereby absorbing toner particles lying on said layer of the developing agent into the layer of the developing agent;

wherein said developing device includes a developing agent regulating member, and a given gap is defined over said developing agent carrying medium within a range from said developing agent regulating member to a place on an upstream side of a direction in which the developing agent is carried during image formation, said developing device further including a developing agent maintaining portion, said developing agent maintaining portion comprising a toner charging portion for charging a toner conveyed from the upstream side to the gap and a toner density controlling portion for controlling a toner density by circulating the developing agent within a space larger in capacity than the given gap on the upstream side of said toner charging portion.

8. A developing machine as recited in claim 7, wherein said developing agent maintaining portion is constructed such that a distance between a bottom surface of said tone charging portion and an axial center of said developing agent carrying medium is within (r+1)mm to (r+10)mm where r is a radius of said developing agent carrying medium.

9. A developing machine as recited in claim 7, wherein said developing device has a developing agent circulation area between said toner density controlling portion and said developing agent carrying medium, through which the developing agent can be fully circulated by pressure against the developing agent within a range of variation of a toner density from 5 to 30 weight percentage with respect to a quantity of magnetic particles contained in said developing device.

10. A developing machine comprising:

a developing agent carrying medium for carrying a developing agent on a surface thereof, the developing agent consisting of toner particles and magnetic particles;

magnetic field generating means disposed within said developing agent carrying medium;

a developing agent regulating member for regulating an amount of the developing agent carried on said developing agent carrying medium; and a developing agent storage case by which a drift space within which the developing agent stopped by said developing agent regulating member drifts is defined between said developing agent carrying medium and said developing agent storage case;

wherein said developing agent storage case includes a developing agent guiding member for guiding the developing agent to an area in which a magnetic flux density of a magnetic field generated by said magnetic field generating means is less than a predetermined value in a direction of a normal of the surface of said developing agent carrying medium while restraining a movement of the developing agent in a direction perpendicular to a direction in which the developing agent is conveyed.

11. A developing machine comprising:

a developing agent carrying medium for carrying a developing agent on a surface thereof, the developing agent consisting of toner particles and magnetic particles;

magnetic field generating means disposed within said developing agent carrying medium;

a developing agent regulating member for regulating an amount of the developing agent carried an said developing agent carrying medium; and a developing agent storage case by which a drift space within which the developing agent stopped by said developing agent regulating member drifts is defined between said developing agent carrying medium and said developing agent storage case;

wherein said developing agent storage case includes a magnetic substance attached to an inner surface of said storage case, and a magnetic pole of said magnetic field generating means is disposed at a place facing a magnetic substance disposed within said developing agent carrying medium.

12. A developing machine comprising:

a developing agent carrying medium for carrying a developing agent on a surface thereof, the developing agent consisting of toner particles and magnetic particles;

magnetic field generating means disposed within said developing agent carrying medium;

a developing agent regulating member for regulating an amount of the developing agent carried on said developing agent carrying medium;

a developing agent storage case by which a drift space within which the developing agent stopped by said developing agent regulating member drifts is defined between said developing agent carrying medium and said developing agent storage case; and a toner containing portion having an opening through which a toner is supplied, the opening being contiguous to said drift space on an upstream side of a direction in which the developing agent is carried and facing said developing agent carrying medium;

wherein an end of said developing agent storage case on the side of said opening through which a toner is supplied is brought close to said developing agent carrying medium at a predetermined distance, and said drift space, as a whole, is closely filled with the developing agent, and wherein an end portion of said developing agent storage case is bent toward said developing agent carrying medium.

* * * * *